US009765544B2

(12) United States Patent
Erlich et al.

(10) Patent No.: US 9,765,544 B2
(45) Date of Patent: Sep. 19, 2017

(54) WATER JET POOL CLEANER WITH OPPOSING DUAL PROPELLERS

(75) Inventors: Giora Erlich, North Caldwell, NJ (US); William Londono Correa, Bloomfield, NJ (US)

(73) Assignee: AQUA PRODUCTS, INC., Cedar Grove, NJ (US)

( * ) Notice: Subject to any disclaimer, the term of this patent is extended or adjusted under 35 U.S.C. 154(b) by 1016 days.

(21) Appl. No.: 13/976,663

(22) PCT Filed: Aug. 11, 2011

(86) PCT No.: PCT/US2011/047435

§ 371 (c)(1),
(2), (4) Date: Jun. 27, 2013

(87) PCT Pub. No.: WO2012/108903

PCT Pub. Date: Aug. 16, 2012

(65) Prior Publication Data

US 2013/0269729 A1 Oct. 17, 2013

Related U.S. Application Data

(63) Continuation-in-part of application No. PCT/US2011/000261, filed on Feb. 11, 2011.
(Continued)

(51) Int. Cl.
*E04H 4/16* (2006.01)
*B08B 9/08* (2006.01)
(Continued)

(52) U.S. Cl.
CPC ..... *E04H 4/1654* (2013.01); *B08B 9/08* (2013.01); *E04H 4/16* (2013.01); *E04H 4/1663* (2013.01);
(Continued)

(58) Field of Classification Search
CPC ..... E04H 4/1654; E04H 4/1663
See application file for complete search history.

(56) References Cited

U.S. PATENT DOCUMENTS 3,618,719 A 11/1971 Marland et al.
4,087,286 A 5/1978 Sexton et al.
(Continued)

FOREIGN PATENT DOCUMENTS

CN 1244747 C † 3/2006
CN 10166168 A † 3/2010
CN 101666168 A * 3/2010 ..... E04H 4/1654

OTHER PUBLICATIONS

Definition of either; www.merriam-webster.com/dictionary/either.*
(Continued)

*Primary Examiner* — Nicole Blan
(74) *Attorney, Agent, or Firm* — Abelman, Frayne & Schwab

(57) ABSTRACT

A robotic pool or tank cleaner is propelled by water jets, the direction of which is controlled by the direction of rotation of a reversible pump motor that is horizontally mounted in the pool cleaner housing that has a propeller attached to either end of the motor drive shaft which projects from opposing ends of the motor body, each of the propellers being positioned in, or near a water jet discharge conduit that terminates in discharge ports at opposite ends of the housing. Each discharge conduit has a pressure-sensitive flap valve downstream of the respective propellers. When the propellers rotate in one direction, the water is drawn through one or more openings in the base plate, passes through one or more filter assemblies associated with the pool cleaner and is discharged through one of the discharge ports as a water jet of sufficient force to propel the pool cleaner.

21 Claims, 14 Drawing Sheets

Related U.S. Application Data

(60) Provisional application No. 61/337,940, filed on Feb. 11, 2010.

(51) Int. Cl.

| | |
|---|---|
| ***B08B 5/00*** | (2006.01) |
| ***B08B 1/00*** | (2006.01) |
| ***B08B 3/00*** | (2006.01) |
| ***B08B 3/04*** | (2006.01) |
| ***B08B 3/10*** | (2006.01) |

(52) U.S. Cl.

CPC . *B08B 1/00* (2013.01); *B08B 3/00* (2013.01); *B08B 3/04* (2013.01); *B08B 3/102* (2013.01); *B08B 3/104* (2013.01); *B08B 5/00* (2013.01)

(56) References Cited

U.S. PATENT DOCUMENTS

| | | | | |
|---|---|---|---|---|
| 4,561,133 | A | 12/1985 | Laing | |
| 5,143,038 | A * | 9/1992 | Dahlgren | F01L 3/205 123/184.54 |
| 5,873,332 | A * | 2/1999 | Taue | F02B 61/045 123/317 |
| 6,379,113 | B1 | 4/2002 | Kim | |
| 6,412,133 | B1 | 7/2002 | Erlich et al. | |
| 6,485,638 | B2 | 11/2002 | Henkin et al. | |
| 6,652,742 | B2 | 11/2003 | Henkin et al. | |
| 7,165,284 | B2 | 1/2007 | Erlich et al. | |
| 7,805,792 | B2 | 10/2010 | Roumagnac | |
| 2004/0074524 | A1 * | 4/2004 | Horvath | E04H 4/1654 134/22.18 |
| 2007/0101521 | A1 | 5/2007 | Erlich | |
| 2008/0099409 | A1 * | 5/2008 | Gorelik | E04H 4/1654 210/780 |
| 2008/0189885 | A1 * | 8/2008 | Erlich | E04H 4/1654 15/1.7 |
| 2008/0235887 | A1 * | 10/2008 | Horvath | E04H 4/1654 15/1.7 |
| 2009/0094765 | A1 | 4/2009 | Osaka | |
| 2012/0273004 | A1 | 11/2012 | Erlich | |
| 2012/0279001 | A1 † | 11/2012 | Fu et al. | |
| 2013/0269729 | A1 | 10/2013 | Erlich | |

OTHER PUBLICATIONS

Definition of condiut; www.oxforddictionaries.com/us/definition/american_english/conduit.*

English Machine Translation of CN 101666168 A.*

International Search Report PCT/US 11/00261 Apr. 8, 2011.

International Search Report and Written Opinion of the International Searching Authority PCT/US 11/47435 Jan. 5, 2012.

* cited by examiner

† cited by third party

FIG. 7
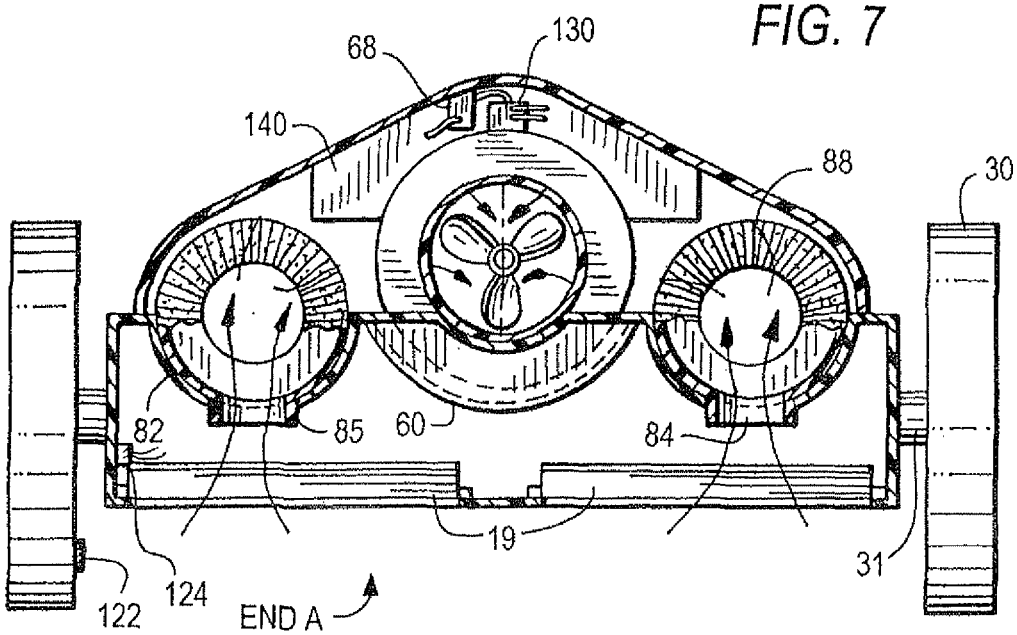
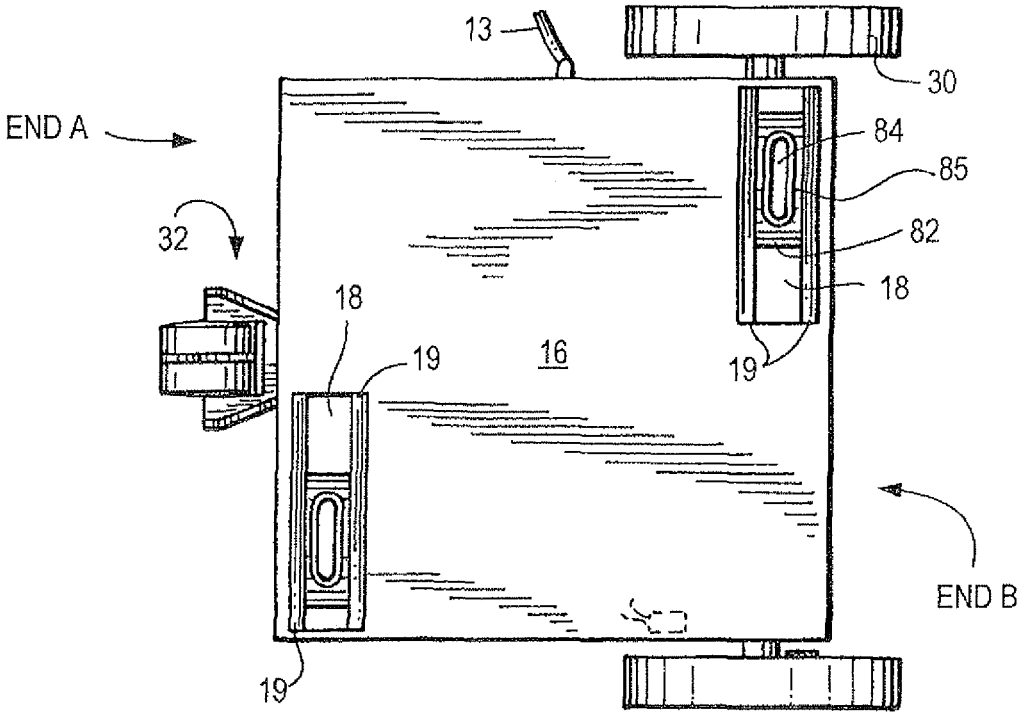
FIG. 8

FIG. 15
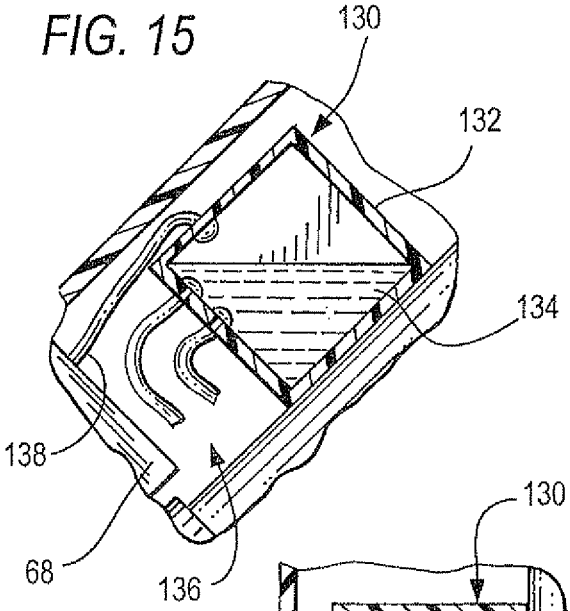
FIG. 16
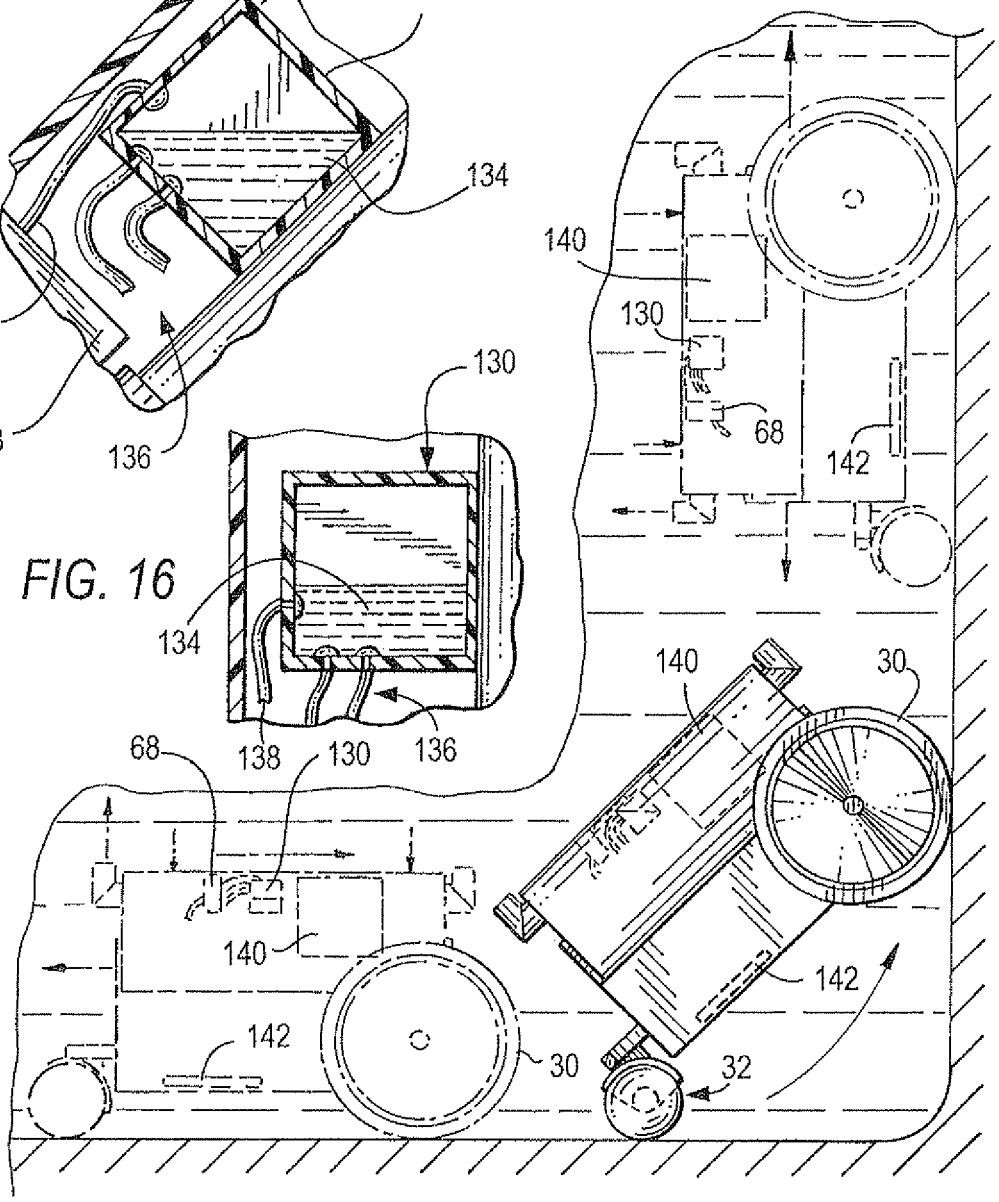
FIG. 14

WATER JET POOL CLEANER WITH OPPOSING DUAL PROPELLERS

CROSS REFERENCE TO RELATED APPLICATIONS

This application claims the benefit under 35 U.S.C. §371 to international application No. PCT/US2011/047435, filed on Aug. 11, 2011, which is a Continuation-in-Part under 35 U.S.C. §365(c) of international application No. PCT/US2011/000261, filed on Feb. 11, 2011, which claims priority under 35 USC §119(e) to U.S. provisional application No. 61/337,940, filed on Feb. 11, 2010, the disclosures of which are incorporated by reference herein in their entireties.

FIELD OF THE INVENTION

This invention relates to methods and apparatus for propelling automated or robotic swimming pool and tank cleaners employing water jet propulsion.

BACKGROUND OF THE INVENTION

A conventional pool cleaner comprises a base plate on which are mounted a pump, at least one motor for driving the pump and optionally a second motor for propelling the apparatus via wheels, rollers or endless track belts; a housing having a top and depending sidewalls and end walls that encloses the pump and motor(s) that are secured to the interior structure and/or the base plate; one or more types of filter media are positioned internally and/or externally with respect to the housing; and a separate external handle is optionally secured to the housing. Power is supplied by floating electrical cables attached to an external source, such as a transformer or a battery contained in a floating housing at the surface of the pool; pressurized water can also be provided via a hose for water turbine-powered cleaners. Tank and pool cleaners of the prior art also operate in conjunction with a remote pump and/or filter system which is located outside of the pool and in fluid communication with the cleaner via a hose.

Automated or robotic swimming pool cleaners of the prior art have traditionally been powered by one or more drive motors which, in some instances are reversible; a separate water pump motor is employed to draw debris-containing water through one or more openings in a base plate close to the surface to be cleaned. The water passes through one or more filters positioned in the pool cleaner housing and is typically discharged vertically through one or more ports in an upper surface of the housing to thereby create an opposite force vector in the direction of the surface being cleaned. This configuration of the apparatus and its method of operation permit the movement of the pool cleaner across the bottom wall and optionally, permit it to climb the vertical sidewalls of the pool, while maintaining a firm contact with the surface being cleaned.

An innovative use of water jets to propel a pool cleaner is described in U.S. Pat. No. 6,412,133, the entire disclosure of which is incorporated herein by reference. A single propeller is attached to the drive shaft projecting from the upper end of a vertically-mounted pump motor positioned in the interior of a pool cleaner housing. The water drawn through the base plate and filter(s) is diverted from a direction that is generally normal to the surface being cleaned by means of a directional flap valve and is discharged in alternating directions through a conduit that is positioned along the longitudinal axis of the pool cleaner in the direction of movement of the pool cleaner; the discharge conduit is generally parallel to the surface being cleaned. In one embodiment, the position of the directional flap valve changes when the water pump stops, or is slowed sufficiently, thereby allowing the water jet to be discharged in the opposite direction and causing the pool cleaner to reverse its direction of movement.

Although the water jet reversing propulsion system of U.S. Pat. No. 6,412,133 has been commercially successful, the size and power requirements of the pump motor must account for certain energy losses associated with changing the direction of the flowing water abruptly as it comes into contact with the directional flap valve and undergoes essentially a 90° change in direction.

It would therefore be desirable to provide an apparatus and method that reduces turbulent flow within the interior of the housing and facilitated the alternating directional discharge of the water jets used to propel the apparatus with a minimum loss in energy due to turbulence.

In the description that follows, it will be understood that the cleaner moves on supporting wheels, rollers or tracks, or a combination of these means that are aligned with the longitudinal axis of the cleaner body when it moves in a straight line. References to the front or forward end of the cleaner will be relative to its then-direction of movement.

SUMMARY OF THE INVENTION

The above objects and other advantages are obtained using the apparatus and method of the present invention which broadly comprehends positioning the pump motor horizontally within the pool cleaner housing, attaching a propeller to either end of the motor drive shaft which extends through and projects from opposing ends of the motor body, and providing opposing water jet discharge openings in the housing, each with a pressure-sensitive flap valve, in axial alignment with the motor's drive shaft and axis of rotation of the respective propellers. When the propellers rotate in one direction, the water is drawn through one or more openings in the base plate, passes through a filter or filters associated with the pool cleaner and is discharged through one of the discharge ports as a water jet of sufficient force to propel the pool cleaner along the surface being cleaned.

In one embodiment, each propeller is securely fixed or mounted to a respective end of the pump motor drive shaft. The water jet created by the propeller is aligned with the adjacent discharge port formed in the end wall of the housing. The force of the water jet is sufficient to open a valve that is positioned downstream of the propeller. The valve can be configured as a split flap valve that is hinged to fold outwardly from a normally closed position, and is designed to produce minimum resistance to the passage of the water jet as it moves toward the discharge port.

In this embodiment, a second flap valve is mounted in a second discharge port located at the opposite end of the housing. The second flap valve is pressed against a rim seal formed in the interior peripheral surface of a discharge duct to close the opposing (second) discharge port. The second flap valve is closed by a water pressure drop created adjacent the second valve in the interior of the housing as a result of the rapid flow of water entering an inlet port, passing through a filter device and flowing out of the open discharge port on the opposite end of the cleaner.

In one embodiment, the propeller adjacent the closed flap valve is also turning to enhance the flow of water towards the open flap valve at the opposite end of the housing. In order to minimize turbulent flow, the opposing ends of the motor body are provided with a curvilinear cap or cover having a streamlined surface configuration that enhances a more laminar flow of the pressurized water created by the rotating propeller. The movement of water across the motor housing at a velocity in the direction of the opposing propeller also enhances the water jet force as it is eventually discharged through the port to provide a force to move the pool cleaner in the opposite direction.

In another embodiment, the propellers are provided with a clutch mechanism so that they will turn in only one direction. In this embodiment, the propeller adjacent the discharge port with its flap valve in the closed position does not rotate; rather, the shaft of the motor spins within the clutch mechanism and applies no force to the propeller mounting. During a cleaning operation, when the motor stops and is reversed, the propeller that had been turning is no longer driven by the drive shaft and the clutch of the propeller on the opposite end is engaged and the propeller rotates, thereby applying a pressurized stream of water against the flap valve, which then opens and discharges a water jet through the discharge duct and out the discharge port, causing the pool cleaner to be propelled in the opposite direction. As previously noted, the valve at the opposite end is closed by the biasing force.

In one embodiment, the end of the discharge conduit on the interior of the housing surrounds the propeller in order to increase the efficiency of the system in moving water through the conduit to the discharge port. The interior of the conduit is advantageously provided with a projecting seat that contacts the edge of the flap valve to form a seal and to limit the range of movement of the valve member(s). The interior surface of the seat can be angled or tapered to join the adjacent conduit surface to minimize turbulence.

In another embodiment, the propellers are positioned adjacent to, but outside of the opening of the discharge conduit in the region between the motor and the interior wall of the pool cleaner that defines the inlet of the discharge conduit. This configuration can be used to advantage when both propellers rotate with the motor drive shaft, that is, when no clutch mechanism is employed. When the propeller is outside of the discharge conduit, but in close proximity to its inlet, there is relatively less back pressure or drag experienced by the non-driving propeller that is at the forward end of the drive shaft in the direction of movement of the pool cleaner than is experienced by the forward propeller when it is surrounded by the discharge conduit. The reduction in drag on the propeller consequently reduces the power drawn by the pump motor, allowing it to operate more efficiently and at a lower cost.

The operation of the pump motor can be controlled in accordance with a predetermined program that interrupts and then reverses the polarity, or direction of the electrical current flowing to the pump motor in response to either a timed sequence, a sensor which detects movement, or lack of movement, or a sensor which is responsive to a vertical wall or other change in position of the pool cleaner, either in the generally horizontal or generally vertical position. Various apparatus, means and methods for controlling the stopping and starting of drive motors and/or pump motors are well-known in the art and form no specific part of the present invention. Similarly, other choices in addition to those specifically described and exemplified herein will be apparent to those of ordinary skill in the art without departing from the scope of the invention.

In one preferred embodiment of the invention, an auxiliary discharge port is positioned above the directional discharge port upstream of the flap valve and in the jet discharge conduit proximate the driving propeller. As used herein, the term "driving propeller" refers to the propeller adjacent the open flap which is producing a water jet that propels the pool cleaner. A reference to the "forward end" or "forward movement" will be understood as a reference to the end facing in the direction in which the pool cleaner is then moving.

The auxiliary discharge port is in fluid communication with a vertical discharge conduit which is generally of a smaller diameter than the conduit passing the propelling water jet, and has an outlet that is oriented vertically when the pool cleaner is positioned on a horizontal surface. Water exiting the vertical conduit produces a force vector that is generally normal to the surface being cleaned. When the pool cleaner is moving over the generally horizontal surface of the bottom wall of a pool or tank, the vertical discharge conduit has the effect of forcing the wheels or other supporting means of the pool cleaner onto contact with the surface. A vertical discharge conduit is positioned at either end of the pool cleaner. In one embodiment, a pressurized water jet exits vertically from only the end at which the water jet is discharged. In another embodiment, water can be discharged from both vertical conduits simultaneously. This relief of pressure by discharge of water through the vertical conduit adjacent the closed valve also serves the beneficial purpose of reducing turbulence. It will be understood that the direction of the "vertical discharge" is relative to the surface being cleaned. When the pool cleaner is ascending or descending a vertical wall, the discharge through the auxiliary discharge port produces an opposite force vector to maintain the pool cleaner in contact with the vertical surface.

The orientation of the discharged water jet can be varied to provide a downward component or force vector, lateral components, or a combination of such components or force vectors to complement the translational force produced by the exiting water jet. Other methods and apparatus can be adapted to achieve the desired combination of force vectors whose resultant provides a sufficient force to cause the pool cleaner to move along the surface being cleaned while also maintaining traction and to permit the unit to reliably ascend and descend vertical wall surfaces. Examples of suitable alternative configurations are also disclosed in U.S. Pat. No. 6,412,133, e.g., in FIGS. 8, 9, 12A, 15-17, 23 and 24 and the corresponding description in that patent's specification, which is incorporated herein by reference.

In one preferred embodiment of the pool cleaner of the present invention, the housing is supported by a pair of wheels mounted for rotation on a transverse axle secured at one end of the housing, and a third swivel-mounted wheel positioned at the opposite end of the housing and located substantially on the longitudinal center line of the cleaner. In the operation of this embodiment, movement of the pool cleaner in a direction in which the two wheels mounted on the transverse axle are at the leading end of the pool cleaner results in the swivel wheel at the opposite end of the housing typically following, and the pool cleaner moves in a generally straight line for cleaning. When the pump motor is stopped and reverses direction, the now-leading swivel-mounted wheel typically rotates to one side or the other, or back and forth between alternate positions, thereby causing the pool cleaner to assume a random or at least curvilinear path. This alternating straight-line or linear movement of the pool cleaner followed by curvilinear movement enables the pool cleaner to traverse most, if not all of the bottom surfaces of the pool during a cleaning cycle.

Another preferred aspect of the invention includes the use of at least one, but preferably, a pair of pleated filter units through which the pool water-containing debris is drawn and the debris retained as the water passes through the housing. In a particularly preferred embodiment, the pair of pleated filter paper cartridges extend longitudinally and their axes are parallel to the axis of the drive motor shaft. The use of these elongated pleated filters has the advantage of reducing the profile of the pool cleaner and thereby the energy required to move it through the water.

The pleated filters are preferably supported to prevent collapse and thereby to enhance their performance and useful life between cleanings and/or replacement. The supporting material can be a wire screen formed of a non-rusting material that is also able to withstand exposure to salt water and/or the treatment chemicals that may be present in the pool water. A particularly preferred support for the pleated filter is a Dutch weave stainless steel wire mesh or screen that is folded in the same configuration as the pleated paper or other natural or synthetic fibrous material that functions to filter the water and retain the debris. Porous plastic supporting materials can also be used.

In addition to using the pleated filter cartridge, the pool cleaner can also be provided with a conventional woven mesh or screen filter to remove larger debris from the incoming flow of water entering from the base plate. In a preferred embodiment, the flexible mesh filter is fitted into the lower region of the housing and positioned above the base plate. Water entering the body first passes through the mesh filter, which entrains larger pieces of debris, e.g. small twigs, leaves, and the like; the water leaving this first stage of filtration then passes into the interior or the pleated filter unit and the smaller debris is trapped on its interior as the filtered water passes through. The use of the primary mesh filter also serves the purpose of extending the life of the pleated filter medium, as well as reducing the frequency of maintenance. Assuming that the pleated filter medium is not punctured, the cartridge can be removed from the unit and back-flushed to permit its reuse.

From the above description, in its broadest construction, the invention comprehends a method of propelling a pool or tank cleaner by means of a water jet that is alternatively discharged in at least a first and second direction that results in movement in opposite translational directions. The direction of the water jet is controlled by the direction of rotation of a horizontally mounted pump motor and propellers mounted on either end of the pump's driveshaft, which illustratively extends horizontally along the longitudinal axis of the pool cleaner. Opposing discharge conduits are axially aligned with the motor's drive shaft and the pressurized water controls the movement of one or more valves that operate in one or more discharge conduits to pass the water for discharge in alternating directions. During the change from one direction to the alternate opposing direction, the motor is stopped and its direction reversed. This interrupts the discharge of water from one discharge conduit, causing the valve to close and the pressure created by the opposing propeller causes the valve to open permitting the discharge of the water jet to propel the unit in the opposite direction.

The invention comprehends methods and apparatus for controlling the movement of robotic tank and swimming pool cleaners that can be characterized as systematic scanning patterns, scalloped or curvilinear patterns and controlled random motions with respect to the bottom surface of the pool or tank. For the purposes of this description, references to the front and rear of the cleaning apparatus or to its ends or end walls of its housing will be with respect to the direction of its movement.

In one embodiment of the invention described below and with reference to the drawings, the pool cleaner is supported by, and moves on a plurality of wheels, which contact the surface being cleaned. In a presently preferred embodiment, wheels are attached to a transverse axle attached to one end of the pool cleaner assembly and a third swivel wheel is mounted at the opposite end of the unit at a position corresponding to the longitudinal axis of the pool cleaner. The turning range or angle of radial movement around the pivot point of the swivel wheel is limited by either fixed or adjustable control elements. This combination of fixed wheels and a pivoting, or swivel wheel produces essentially straight-line movement in the direction in which the third wheel is trailing and a curvilinear cleaning pattern when the third wheel is leading. Various mechanical and/or electromechanical means known to the art can be utilized to control and vary the directional position of the swivel wheel to thereby create different and varying patterns of curvilinear movement of the pool cleaner.

As will be understood by those of ordinary skill in the art, the pool cleaner can also be provided with a second pair of axle-mounted wheels in place of the single swivel-mounted wheel. The use of a set of wheels at opposing ends of the pool cleaner can be used to provide for more regular patterns of movement than the random movement associated with the swivel wheel. For example, one or both ends of one or both of the two axles can be positioned in fixed or adjustable slots that permit the respective portion(s) of the axle(s) to move in response to a change in direction.

The illustrative figures which accompany this application, and to which reference is made herein, schematically illustrate various embodiments of the invention as applied to robotic cleaners equipped with wheels; however it will be understood by those of ordinary skill in the art that the invention is equally applicable to cleaners which move on transverse rollers and endless tracks or belts.

BRIEF DESCRIPTION OF THE DRAWINGS

The invention will be described in further detail below and with reference to the attached drawings where the same or similar elements are referred to by the same number, and in which:

FIG. 7 is an end view, partly in section taken along line 7-7 of FIG. 1, illustrating the flow path of water entering and passing through the filters and interior of the pool cleaner body;

FIG. 8 is a bottom view showing one embodiment of a base plate having two inlet ports for admitting water flow through the filters;

FIG. 14 is a side elevation view illustrating the cleaner of FIG. 1 with a mercury switch responsive to changes in the orientation of the pool cleaner, e.g., during ascent and descent of sidewall of a pool;

FIGS. 15 and 16 are side elevation views in cross-section illustrating the mercury switch of FIG. 14 in various conductive activation states;

FIG. 16 is a side elevation view in cross-section illustrating the mercury switch of FIG. 14 in a conductive activation state.

Figure 1:
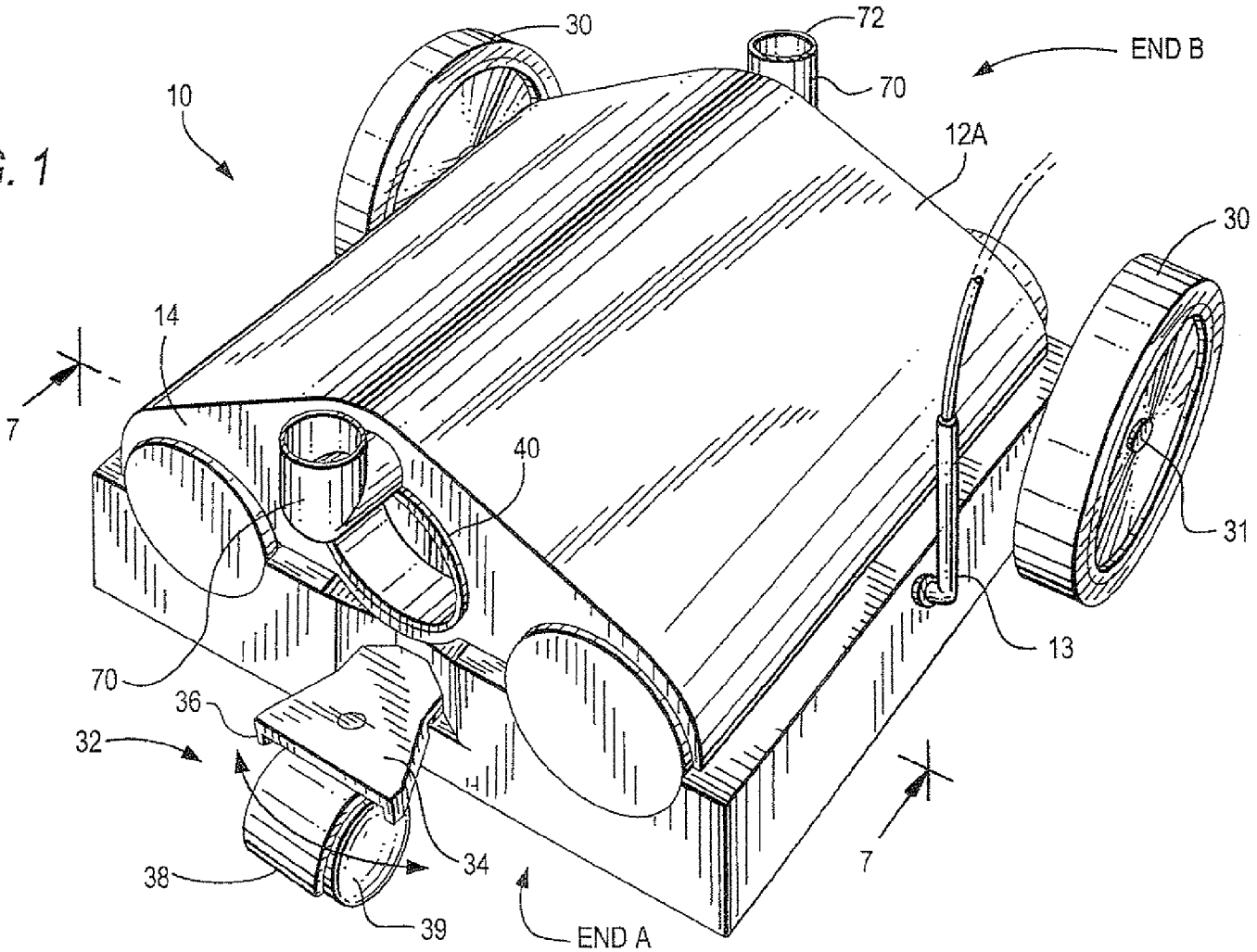
FIG. 1 is a top, side and end perspective view of a pool cleaner illustrating one embodiment of the directional water jet system and apparatus of the invention.

To facilitate an understanding of the invention, identical reference numerals are used, when appropriate, to designate the same or similar elements that are common to the figures. Further, unless stated otherwise, the features shown in the figures are not drawn to scale, but are shown for illustrative purposes only.

DETAILED DESCRIPTION OF PREFERRED EMBODIMENTS

In the description that follows, a pool or tank cleaner 10 has an exterior cover or housing 12 with a top wall 12A, an internal pump and drive motor 60 that draws water and debris through openings in a base plate that are entrained by one or more filters 88.

Referring to FIGS. 1-4, 7 and 8, illustrated is an embodiment of the cleaner 10 having a single motor that enables the robotic pool cleaner 10 to vacuum debris while being propelled over the submerged pool surface using one relatively simple directional control means. In this embodiment, a reversal of the polarity of the power input to the motor results in the reversal in direction of the pool cleaner's movement. This change (e.g., polarity reversal) in the power to the motor can result from a programmable power control circuit that is initiated by physical conditions affecting the cleaner (e.g., sensing a wall of the pool or surface of the water), or in accordance with a timed program, i.e., 30 seconds to one minute in one direction and then a change in the direction of rotation of the pump motor for a like or different period of time.

With continuing reference to FIG. 1, the pool cleaner 10 includes a housing, referred to generally as 12, that includes of an upper cover portion 12A and a lower body portion 12B which are securely fitted or joined together to provide a unitary structure. A floating or buoyant power cable 13 supplies low voltage power from an external (remote) power source (not shown) as is well-known in the art. Means for controlling and reversing the polarity of the current supplied to the DC motor can be located at the remote power source or included in a processor/controller device 68 (FIG. 4) mounted in the interior of the pool cleaner housing 12. The processor/controller 68 can be programmed in accordance with methods known in the art to interact with a timer and/or one or more sensors or switches to effect the functioning and directional control of the pool cleaner.

The pool cleaner body is supported by a pair of wheels 30 mounted on axle 31, which is mounted or otherwise installed transversely to the longitudinal axis of the pool cleaner as defined by direction of movement. A third supporting wheel assembly 32 is mounted at the end opposite the transverse axle. For purposes of clarity in further describing the invention, the pair of wheels 30 are illustratively shown as being mounted proximate second end "B" of the cleaner 10 and the wheel assembly 32 is illustratively shown and labeled as being mounted at opposing first end "A" of the cleaner 10. In one embodiment, wheel assembly 32 includes a mounting bracket 34 with downward projecting flanges 36 that engage a wheel support member 38, which retains and controls the angular or radial range of movement of wheel 39. As will be apparent to those of ordinary skill in the art, the angular range of movement can be controlled by providing adjustable pins, which can be repositioned by the user. Further, the illustrative wheel assembly 32 shown in FIG. 1 is not considered limiting as a person of ordinary skill in the art will appreciate that other well-known wheel assemblies such as a center rotational wheel assembly, a mechanum wheel, a spherical wheel assembly, and the like can also be utilized.

Figure 4:
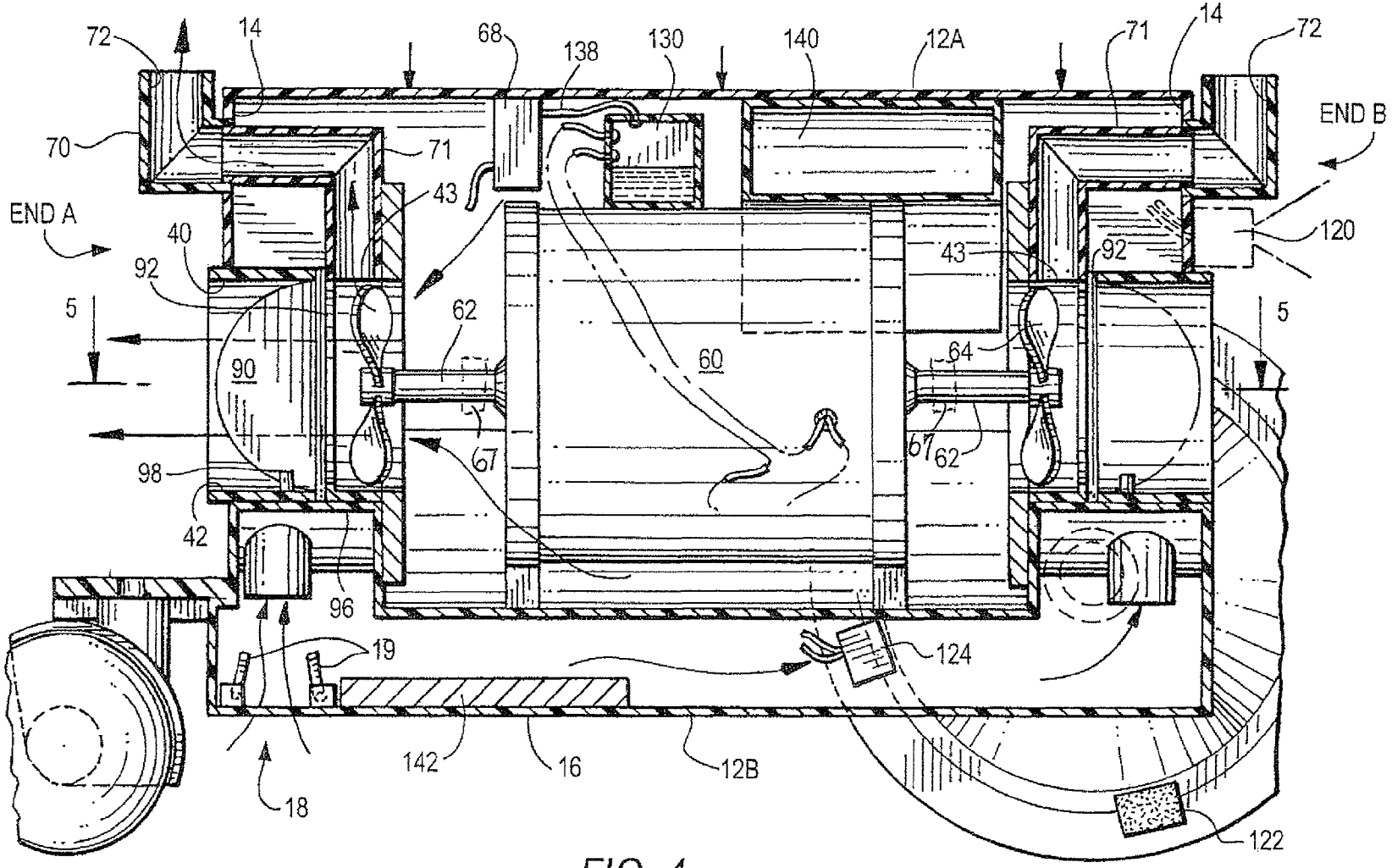
FIG. 4 is another partial side elevation view in cross-section taken along line 4-4 of FIG. 2 illustrating a propulsion system having a motor and opposing propellers.

With continuing reference to FIGS. 1 and 4, the pool cleaner cover includes opposing front and rear end walls 14, in each of which there is formed a water jet discharge port 40 as best shown in FIG. 4. Also shown in FIGS. 1 and 4 are opposing vertical discharge conduits 70, each of which has a lower end connected to a respective conduit section 71 mounted in the interior of the housing 12 and the upper end terminating in a vertical discharge port 72. The vertical discharge ports 72 are positioned at the opposing ends of the cleaner 10, and their function is described below in further detail. As will be described in further detail below, the discharge conduits 70 can be configured as a single straight section of conduit to minimize energy losses associated with directional changes.

Figure 2:
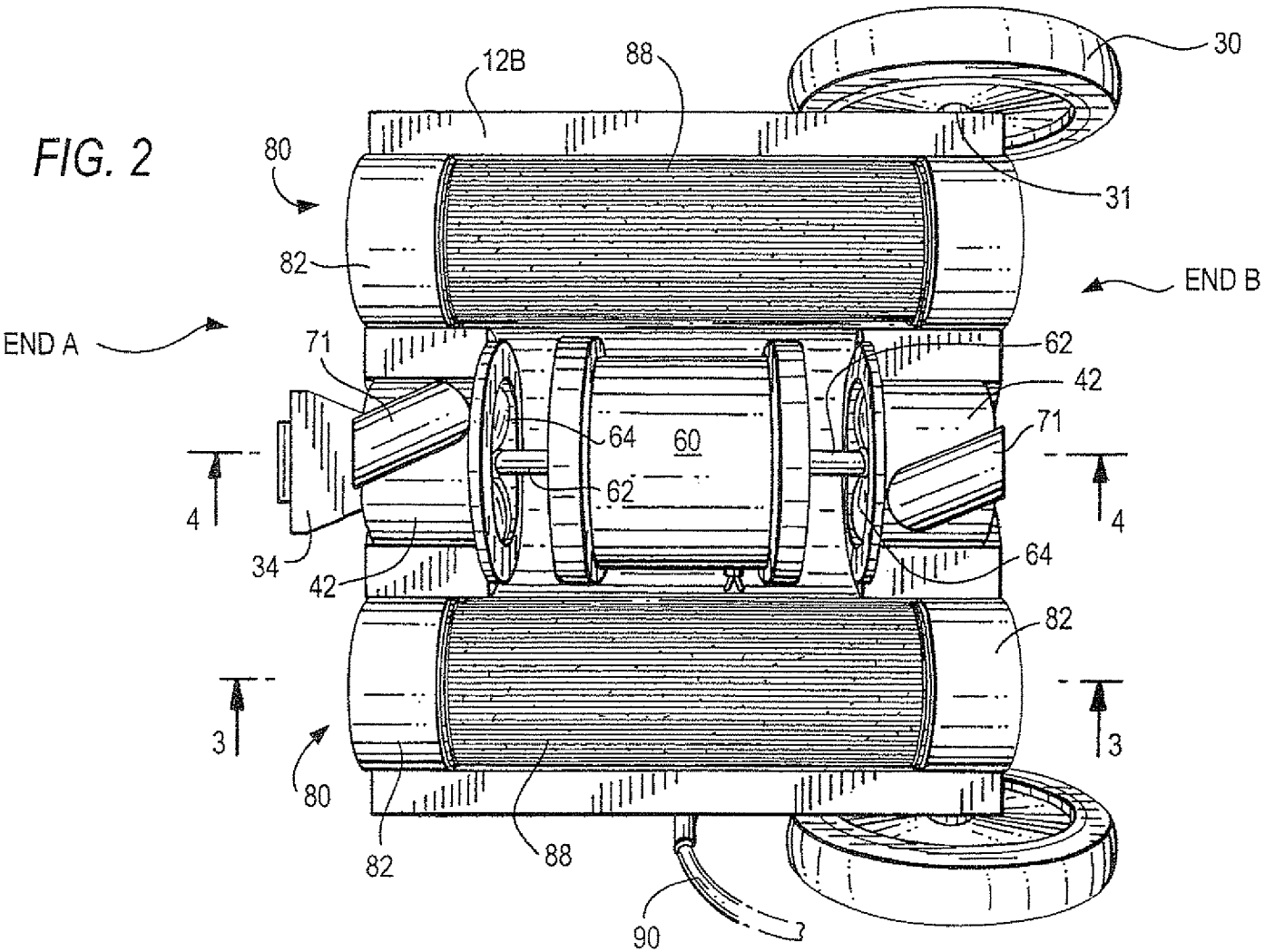
FIG. 2 is a top view of the pool cleaner of FIG. 1 with the upper portion of the housing removed to reveal the interior arrangement of the components.

Referring now to the top view of FIG. 2 from which cover portion 12A has been removed, horizontally mounted motor 60 with drive shaft 62 projecting from both ends supports opposing propellers 64. As can best be seen in the cross-sectional view of FIG. 4 the propellers 64 are, respectively, positioned in closely-spaced relation to longitudinal water jet discharge conduits 42, each of which terminate with discharge ports 40. Each of the longitudinal discharge conduits 42 are also provided with an outlet 43 positioned downstream of the propeller and in a zone of high hydraulic pressure. As clearly shown by reference to FIGS. 1 and 4, the vertical discharge conduits sections 71 and 70 form a continuous path communicating with the outlet 43 to direct a stream of pressurized water in a direction that is normal to the surface being cleaned, e.g., vertically when the unit is moving on the horizontal bottom wall of a pool or tank, the stream being discharged through vertical discharge port 72. In the embodiment illustrated in FIGS. 1-4, the external portion of the vertical discharge conduits 70 is affixed to the end wall 14 of the upper cover portion 12A. A fluid-tight fitting is provided where the conduit section 71 is joined to the water jet discharge conduit 42.

Although the vertical discharge conduit section 71 and 70 are each illustratively configured with two right angle elbows, a person of ordinary skill in the art will appreciate that a straight or angled conduit can also be provided to extend from the outlet 43 positioned downstream of the propeller through the top surface of the upper cover portion 12A. For example, referring to FIG. 9A, the vertical discharge conduit 70 extends upwards directly from the outlet 43 and through the upper cover portion 12A without directional change at the two elbow fittings 71 formed between the discharge inlet opening 43 and discharge port 72. In an alternative embodiment, the straight conduit 70 can be angled from the inlet opening 43 and extend through the upper cover portion 12A to produce a force vector having a vertical component and a horizontal component. In this latter embodiment, the water discharged through the discharge port 72 produces a force vector component that is perpendicular to the base plate 16 to maintain the cleaner on a surface of the pool, as well as a horizontal force vector component to assist in propelling the cleaner along the longitudinal axis of the cleaner 10. As previously noted, the use of the terms "horizontal" and "vertical" are with reference to the surface on which the pool cleaner is positioned and/or moving.

Figure 5:
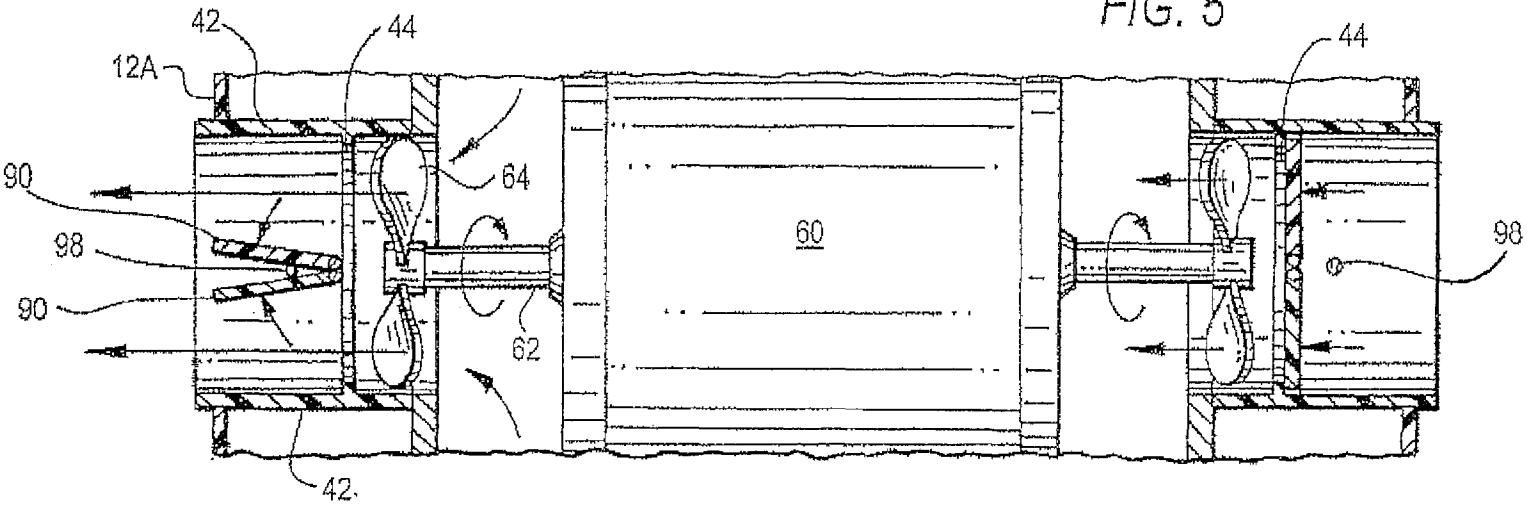
FIG. 5 is a top, enlarged view, partly in section, illustrating the propulsion system positioned between opposing discharge conduits, each of which includes a split flap valve and illustrated in an open and closed positions.

The positioning and functioning of split flap valves 90 are now described with reference to the side elevation view in cross-section of FIG. 4 and the top, partial sectional view of FIG. 5. The flap valves can illustratively include two centrally hinged portions that can pivot into open and closed positions in the center of the water jet discharge conduit. Each pair of valve sections 90 include a support element 92, which is secured into upper and lower recesses in the discharge conduit 42. A central partition element 98 is shown projecting from the interior wall of conduit 42 to prevent the valve elements from coming into contact with each other and from moving beyond the defined range, which will thereby enable them to close when the rotational direction of the propellers 64 is reversed. In actual practice, the spacing between the open flap valve sections can be minimized beyond that shown for purposes of illustration in FIG. 5. The interior wall of conduit 42 is also provided with a projecting peripheral band or seal 44 against which the closed valves on the right side of the figures are shown resting. In a preferred embodiment, the upstream portion of the projecting seal 44 is contoured to minimize turbulence in the passing jet stream.

Figure 6:
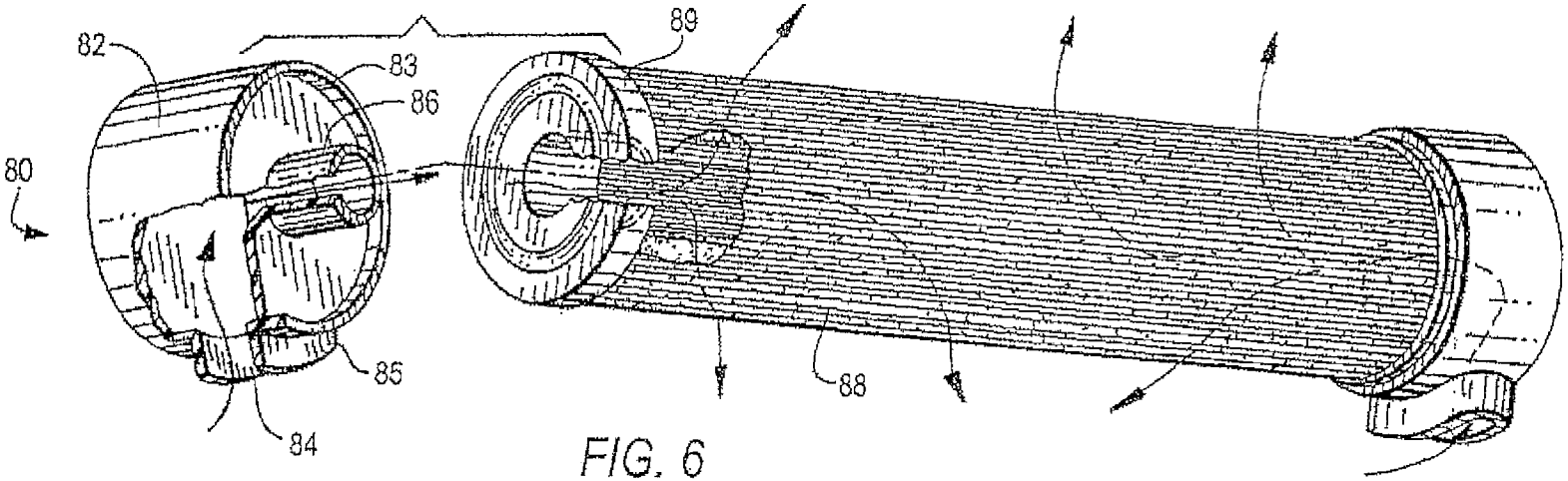
FIG. 6 is an exploded perspective view of a first embodiment of a filter and related components as shown, e.g., in FIG. 3.

Referring now to FIG. 6, a first embodiment of the filter 88 is provided with end caps 80 that include a body portion 82, and inlet 84 having extending walls 85 configured to produce a suction force in the vicinity of the base plate inlet ports 18, as described in more detail below, and an outlet tube 86 which mates in close-fitting relationship with the inlet of pleated filter unit 88. In one embodiment, filter 88 can be formed of a paper material that is pleated or corrugated to increase surface area. The body portion 82 is also preferably provided with a projecting peripheral flange 83 that is dimensioned and configured to mate securely with the outer periphery of the end collar 89 of the filter 88. As clearly shown in FIGS. 2, 3 and 5, the filter 88 is fitted with a cap 80 at each end through which water containing debris is admitted and circulates through the filter medium, which retains the debris and passes the filtered water through the open discharge conduit 42 under the influence of the motor-driven propellers 64.

Figure 12:
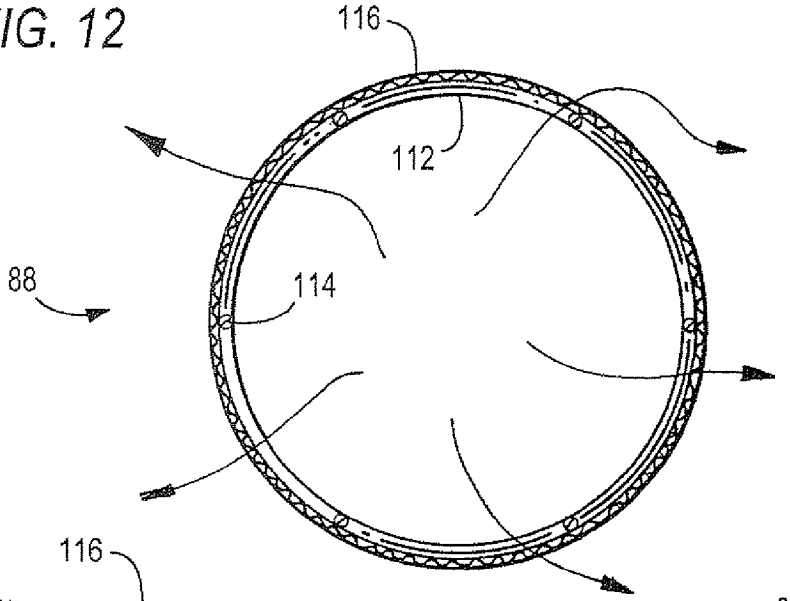
FIG. 12 is a cross-sectional view of the filter of FIG. 11 illustrating the flow of filtered water through the filter.
Figure 11:
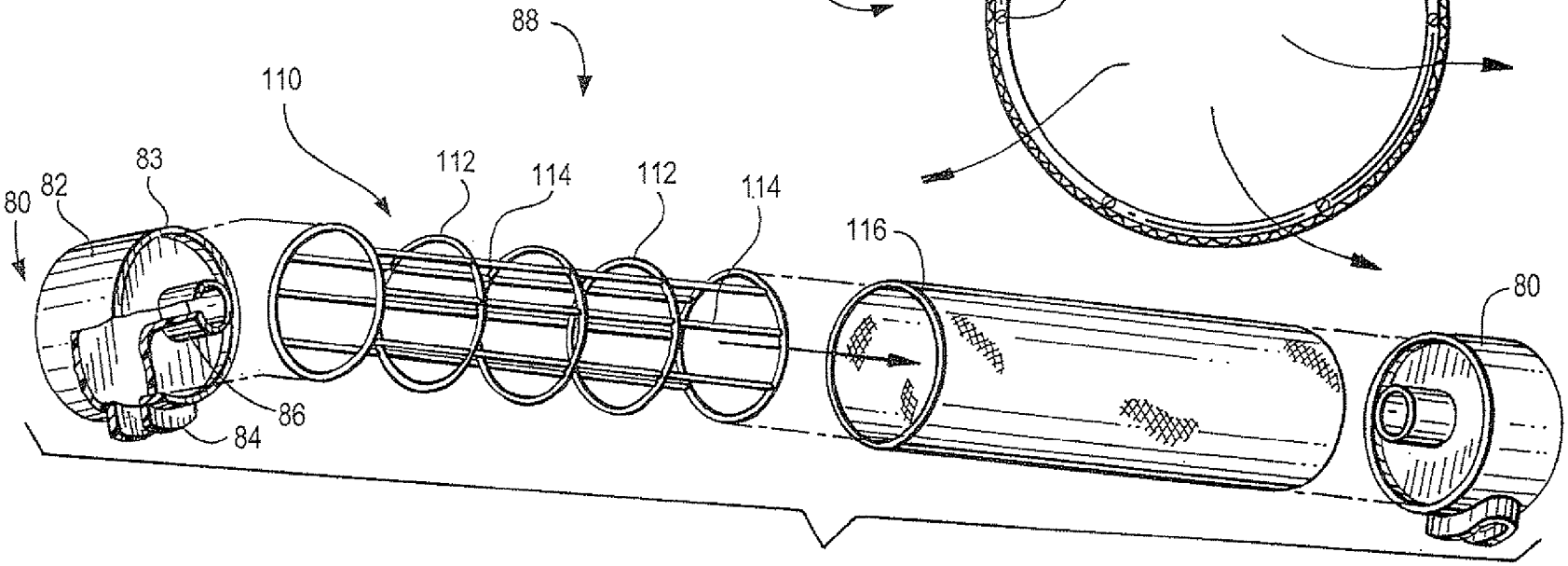
FIG. 11 is an exploded perspective view of a second embodiment of a filter and related components suitable for use in the cleaner of FIG. 1.
Figure 13:
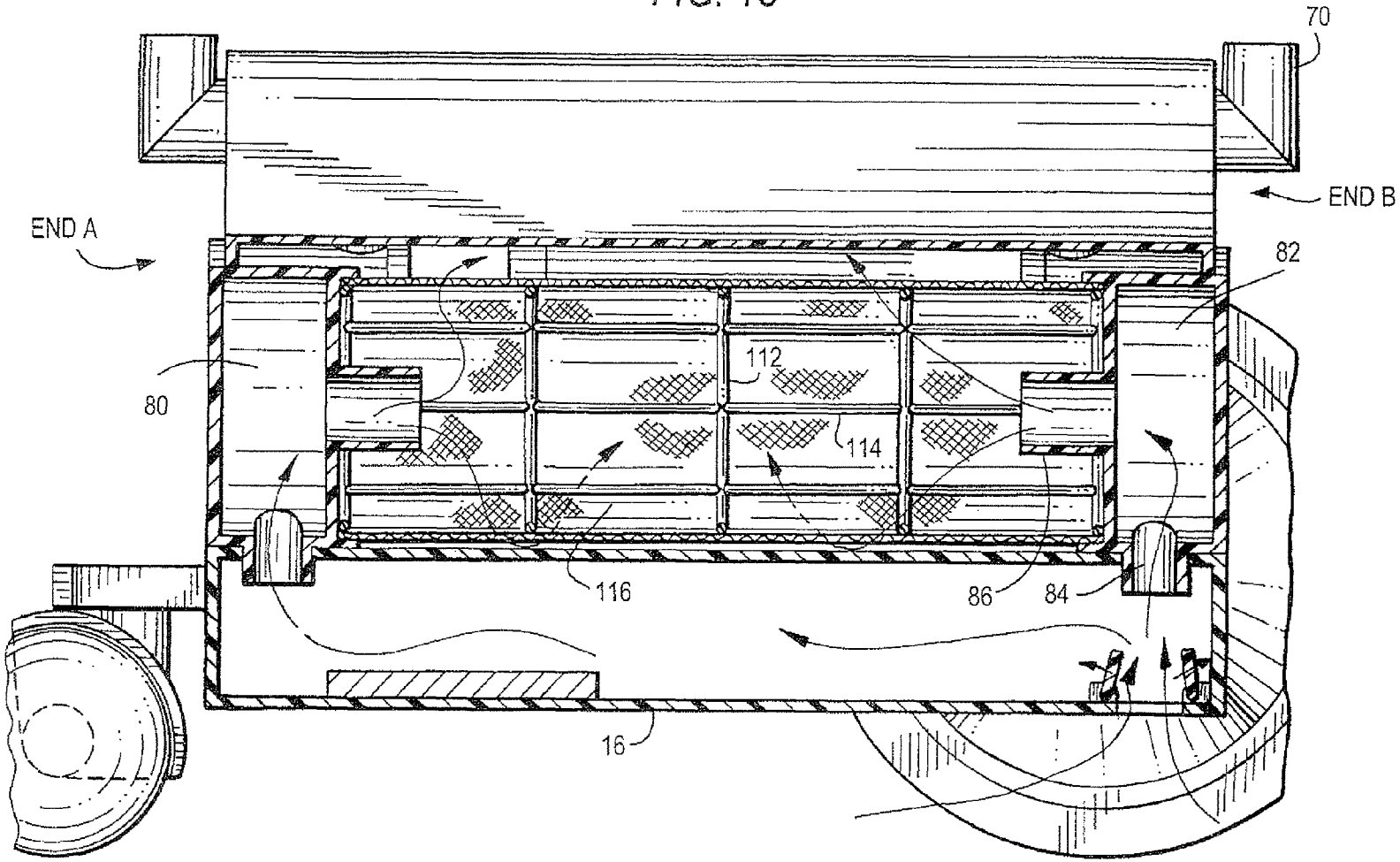
FIG. 13 is a partial side elevation view in cross-section illustrating the filter of FIG. 11 installed in the pool cleaner of FIG. 1.

Referring to FIGS. 11, 12 and 13, an alternate embodiment of the filter 88 is illustratively shown that include use of a conventional mesh material 116 in place of the pleated paper material of the cartridge-type filter described above. The mesh material 116 can be supported on an open framework or by an associated stainless steel Dutch weave wire mesh, although other types of woven open-mesh metal and fibers, as well as molded polymeric flexible and/or rigid filter screens can be used. The mesh material 116 is formed as a tubular member that extends between the opposing caps 80 as described above. A person of ordinary skill in the art will appreciate that the wire mesh can be woven loosely or tightly to form larger or finer spaces between the individual wire/fiber strands to remove various undesirable particles in different types of environments that the cleaner is used.

Preferably, the pleated paper or the woven mesh is supported by a larger mesh like structure or support member 110 that supports the inner circumference of the paper or woven mesh. In one embodiment, the support member 110 includes a plurality of spaced-apart concentric rings 112 that are aligned and secured together by a plurality of spaced-apart cross members 114. The support member 110 is sized to support the inner surface of the filter material 88 and the end caps 80. As shown in FIGS. 12 and 13, water flows into the inlet 84, through the outlet tube 86 of the end caps 80 and out the tubular sidewall formed by the circumference of the paper or woven mesh to trap the undesirable debris within the filter 88.

As previously noted, upper cover portion 12A is removable to permit convenient access to the interior of the body, e.g., for maintenance of the filters 88. The filter assemblies are preferably supported and held in position by the upper and lower body portions 12A and 12B. Other configurations of filter supports and assemblies known in the prior art can be used with the invention.

Figure 3:
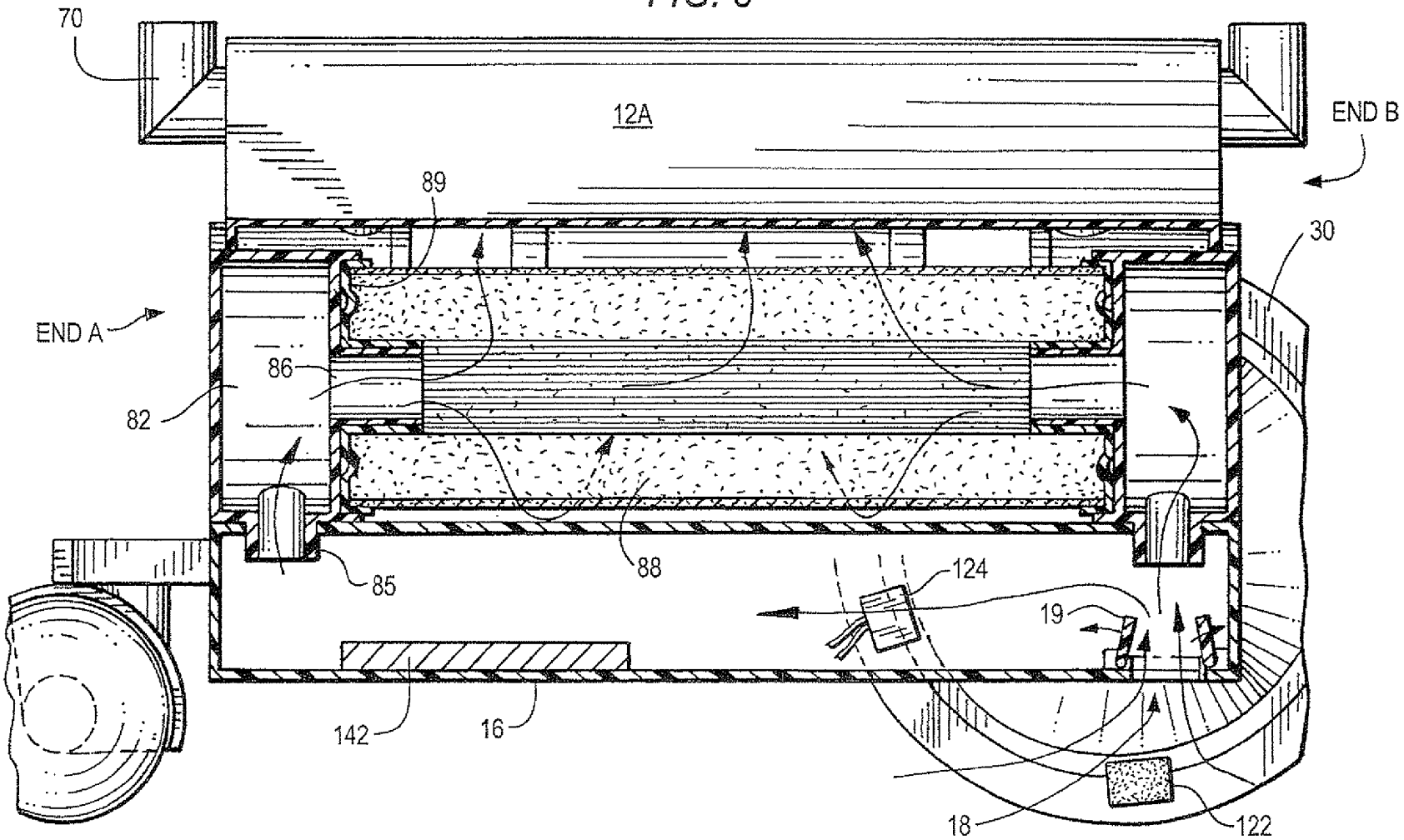
FIG. 3 is a partial side elevation view in cross-section taken along line 3-3 of FIG. 2.

As best shown in FIGS. 3 and 4, the base plate 16 is positioned in close proximity to the surface of the pool or tank that is to be cleaned and water is drawn through a number of base plate inlet ports 18 that extend transversely to the longitudinal axis of the pool cleaner. In the preferred embodiment shown, inlet closing flaps 19 are bias-mounted so that they open under the influence of the water drawn through the inlet port 18 and close when the flow of water caused by the propellers 64 is discontinued. This arrangement has the advantage of preventing any loose debris that may have been drawn into the interior of the pool cleaner housing 12 to be retained for eventual removal by the user when the pool cleaner 10 is shut down and being removed from the pool.

In describing the method of operation of the pool cleaner of the invention, it will be understood that the direction of the rotation of the motor 60 is effected by changing the polarity of the power supply. This technique is well-known in the art and a particular means for accomplishing this change does not form part of the present invention. This reversal of polarity can be accomplished using a programmed controller 68 and other appropriate circuit elements well-known in the art. As previously noted, the change in direction of rotation of the motor can be the result of a predetermined program which is specifically designed to result in a random pattern of movement of the pool cleaner that will result in the cleaning of all or substantially all of the desired pool surface(s). Other changes can be the result of signals emanating from various types of optical, mechanical and/or radio frequency devices. Similarly, control signals can be generated by one or more sensors 120 which detect the motion of, or the absence of movement of the pool cleaner, e.g., when the pool cleaner's forward motion is stopped by encountering a wall or an obstacle such as a ladder.

Referring to FIG. 4, in one embodiment, a sensor 120 (shown in phantom) is illustratively provided at the end of the pool cleaner 10 having the pair of wheels 30 mounted thereto. The sensor 120 can be a switch having a push rod or button that actuates upon contact with the sidewall of the pool, or a sensor that uses sonar or light (laser) to detect the sidewall, among other well-known sensors capable of detecting a sidewall or vertical structure in the pool.

Preferably, the sensor 120 is a magnetic pickup switch 124 that is coupled to one or more wheels 30, as also illustratively shown in FIG. 4. One or more magnets 122 are positioned on the inner circumference of the wheel 30, and an inductor 124 is mounted to the chassis proximate the inner circumference of the wheel 30. The magnetic pickup (inductor) 124 senses the magnet 122 as the wheel 30 turns and sends a control signal to the controller 68. The controller 68 includes a timing circuit that determines whether the wheel(s) have stopped rotating for a predetermined time, such as when the unit has come to a stop at a sidewall of the pool. During operation, when the timing circuit times out or the sensor 120 detects the sidewall, the controller 68 optionally interrupts power to the motor 60, thereby terminating the discharge of water. In one embodiment, the polarity of the motor is reversed and the pool cleaner commences movement in a different direction. In an alternative embodiment described in more detail below, the pool cleaner is programmed to assume a wall-ascending position.

Other magnetic sensors of the types described in U.S. Pat. No. 6,758,226 can be coupled to the pool cleaner's processor/controller to provide a periodic signal while the unit is moving, while a predetermined delay will result in a change in direction of the pump motor. In one embodiment, a reed switch is opened or closed to generate the signal. Other motion detecting systems known in the art can be adapted for use.

The pool cleaner 10 is placed on the bottom of the pool or tank to be cleaned and power supplied to the motor 60, which causes one or both of the propellers 64 to rotate with the motor's drive shaft 62. In accordance with the directional references indicated in FIGS. 4 and 5, water containing debris is drawn from below the base plate 16 through inlet port 18 and passes through end caps 80 and into filter intake opening 84 located at either end of the two pleated filter units 88. Debris is trapped in the filter medium and the filtered water flows through the external pleated (or mesh) filter 88 material. The filtered water is drawn through the housing by the rotating propeller 64 on the left side and a principal water jet is directed by discharge conduit 42 to exit via discharge port 40, thereby moving the unit to the right. Simultaneously, a lesser volume of water is discharged from downstream of the propeller through opening 43 in conduit 42 and is discharged via communicating conduits 71 and 70 vertically through port 72. The vertically discharged water exiting from the port 72 provides a force vector normal to the base plate 16 that acts to maintain the moving pool cleaner in contact with the surface being cleaned.

As will be understood by one of ordinary skill in the art, the water jet discharge conduits 40 can alternatively be positioned at an angle other than horizontal to the surface being traversed by the pool cleaning apparatus. For example, a downward thrust or force vector can be provided to assist in maintaining the apparatus in contact with the surface over which it is traveling by positioning the respective discharge conduits 40 at an acute angle to the horizontal. Similarly, an upward thrust or vertical force vector can be provided by declining the exhaust tube below the horizontal. The end of the discharge conduit 40 can be divided so that the exiting water jet stream is split into a horizontal vector and an upward (or downward) discharge stream. A further method for controlling the directional discharge is by use of a plate or rudder, either fixed or adjustable by the user that is positioned in the end of the discharge conduit.

Figure 9A:
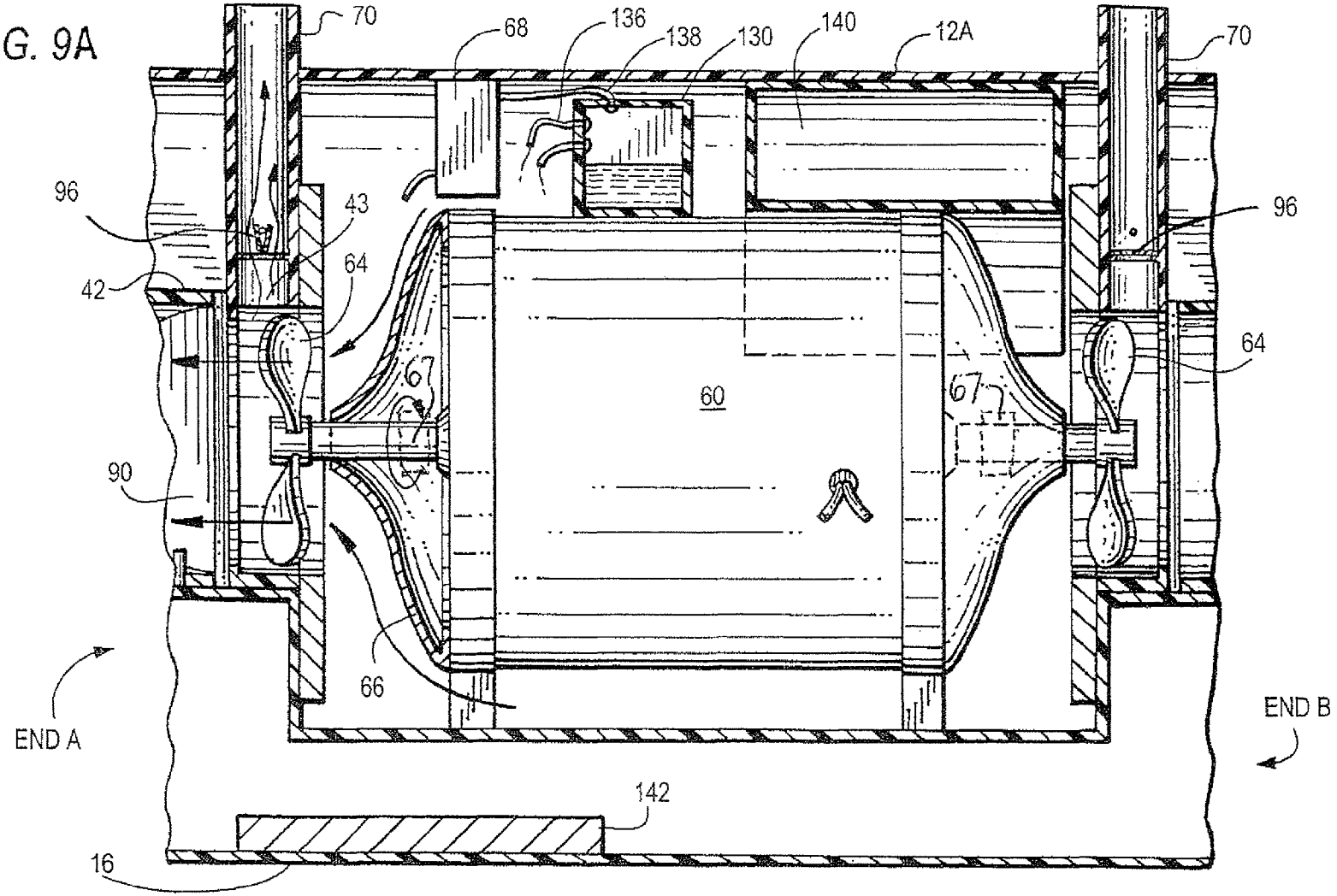
FIG. 9A is an enlarged cross-sectional view illustrating an embodiment of streamlined end caps fitted to the end plates of the motor and water alternately flowing through opposing vertical conduits, each of which being positioned proximate a respective propeller and discharge conduit.

In the embodiment in which both propellers 64 rotate simultaneously, the propeller shown on the right end of the pool cleaner in FIG. 4 also is pushing water in the direction of the open flap valve 90 located at the left end of the pool cleaner. In order to facilitate the flow of water around the intervening pump motor housing 60, contoured caps 66 are optionally fitted to the end plates of the motor housing as shown in FIG. 9A. The contours of the caps 66 are dimensioned and configured to reduce turbulence and facilitate the most energy-efficient flow of water along the longitudinal path defined by the housing 12 and the body of motor 60.

Referring to FIG. 9A, a flap valve 96 or other water flow restraining device is optionally provided in each vertical discharge tube 70 to alternatively preclude or permit movement of water into or out of the housing through the vertical discharge port 72. In one embodiment, a flap valve 96 is mounted in the interior of the vertical discharge tube 70 proximate the discharge inlet 43, although such location along the interior is not intended to be limiting. For example, the flap valve 96 or a cap (not shown) can be mounted proximate the vertical discharge port 72 to preclude or permit the passage of water. Referring to FIG. 4, the flap valves (not shown) are also preferably mounted in the interior of the vertical discharge tubes 70 proximate the discharge inlets 43, although such location is not intended to be limiting.

During operation, when a main discharge flap valve 90, e.g., flap valve on the left side of FIG. 9A, is open and water is moving (expelled) through the discharge opening 40, the turbulent pressure created by the rotation of the adjacent left side propeller 64 will also cause the left vertical flap valve 96 to open. Accordingly, pressurized water can flow through the vertical tube 70 and is discharged through the vertical discharge port 72 to produce a downward force vector or component normal to the base plate 16. At the opposite end of the cleaner 10, the turbulent pressure created by the rotation of the right side propeller 64 that is positioned adjacent the closed discharge flap valve 90 causes the vertical flap valve 96 to return to its normally biased closed position. In this manner, water from the pool is prevented from being drawn into the right side vertical tube 70 and flow into the high velocity/low pressure region downstream of the propeller.

In an alternative embodiment, the invention comprehends the use of two separate motors (not shown) whose axes of shaft rotation are coincident, instead of a single motor 60. Preferably, a programmable processor controller regulates the rotations of the shafts of the two axially aligned motors. In this embodiment, a first motor is provided with power to turn the propeller that produces the motive jet stream and the adjacent and opposing (second) motor is stopped to reduce turbulence inside the housing 12. When the directional movement of the cleaner is reversed, the power to the rotating motor is interrupted and the second motor is activated. The flap valves 90 and 96 operate in a similar manner as described above with respect to the embodiment shown with a single motor 60.

In addition to, or in place of the discharge of a vertical stream, pressurized water can also be delivered via a tube or tubes to the underside of the pool cleaner for the purpose of lifting debris into suspension for capture by the water flowing into the inlet ports 18 formed in the baseplate 16. Various examples of arrangements for creating a pressurized stream and various modes of delivering it to the underside of the baseplate 16 for this purpose are shown and described in U.S. Pat. No. 6,412,133, as well as in U.S. Pat. Nos. 6,971,136 and 6,742,613, the disclosures of which are incorporated herein in their entirety.

Figure 9B:
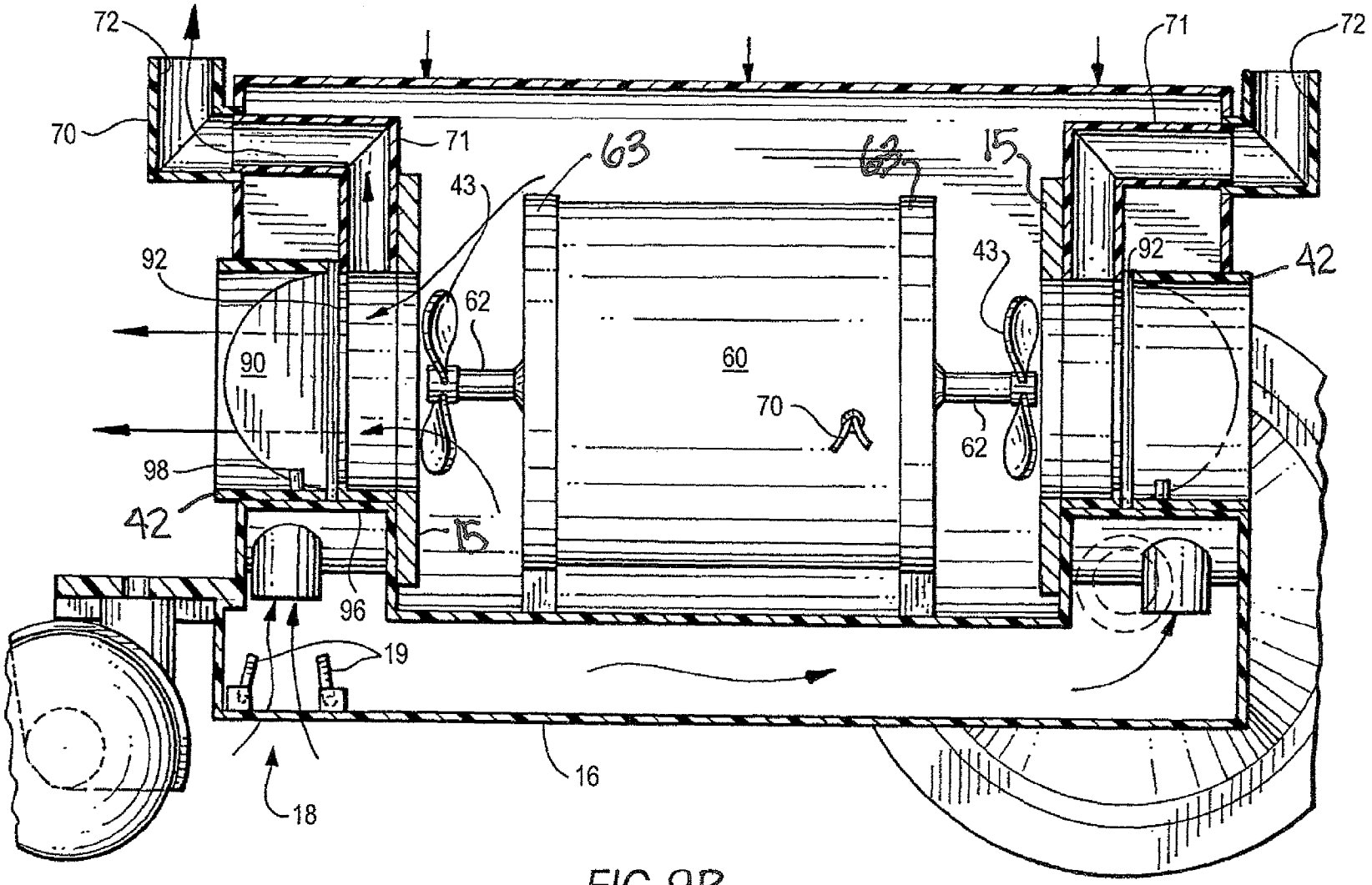
FIG. 9B depicts another embodiment in which the propeller blades are positioned outside of, and adjacent to the openings of the discharge conduits.

Referring now to FIG. 9B, an embodiment of the invention is shown in which each of the respective propellers are displaced to a position that is adjacent and in close proximity to the discharge conduit (42), rather than being located within the conduit as shown, for example in FIGS. 2, 4, 5 and 9A. As shown in FIG. 9B, each propeller is mounted on a drive shaft (62) extending from either end of the motor (60). The diameter of each of the propeller blades (43) is somewhat smaller than the diameter of the blades shown in the embodiment, for example, of FIG. 4. The blades are positioned in the open interior space between the end caps (63) of the motor (60) and the interior wall surface (15) of the housing that surrounds the inlet opening of the conduit (42).

In operation, the rotation of the propeller at the end of the motor opposite the direction of movement produces a jet of water that is discharged through conduit (40) to propel the pool cleaner forward. Reducing the size of the propeller allows the water pushed away from the propeller blade to enter the adjacent discharge conduit (42) with a minimum of turbulence produced by direct impact with interior wall (15) surrounding the conduit opening. As will be understood by those of ordinary skill in the art, the volumetric flow rate of water from the moving propeller blade into the discharge conduit is related to the diameter of the propeller blade and its position with respect to the inlet opening of the conduit. These dimensional and spatial relationships will also effect the current drawn by the motor which is related to the turbulence, back pressure and drag experienced by the respective propellers.

This arrangement also has been found to be advantageous when no clutch is installed to discontinue rotation of the non-driving propeller at the opposite end of the motor, i.e., at the end of the pool cleaner that is moving forward. When closed, each pair of flap valve panels 90 functions as a door across the adjacent conduit opening 40. Although the elements, i.e., flap valve sections or panels 90 forming the door are closed across the conduit opening 40 at the forward end, the turbulence created by the rotating propeller blade moving in the open region between the end of the motor and the central wall 15 surrounding the closed conduit creates less drag or resistance force on the rotating propeller than when the propeller is in the confined space surrounded by the discharge conduit 40 and the closed door or flap valve panels 90 as in the embodiment illustrated in FIG. 4.

The beneficial effects of reducing the diameter of the propeller and moving the propeller from a position inside of the discharge conduit, as illustrated in FIG. 4, to a position proximate to, but just outside of the discharge conduit, as illustrated in the embodiment of FIG. 9B, was determined by measuring the amps drawn by the motor 60 with the propellers in the alternative configuration displaced from the interior of the discharge conduit. With the propellers positioned as in FIG. 4 and the propeller at the forward end immobilized by virtue of an optional clutch 67 (FIG. 9A), shown in phantom, the motor 60 was observed to draw 2.5 amps during operation of the jet drive. When the motor was used to rotate both propellers in the configuration of FIG. 9B, the current drawn was 3.5 amps. This is an acceptable value that will not adversely affect the useful life of the motor. When both propellers were rotated in the configuration of FIG. 4, i.e., with each propeller inside of, and surrounded by its respective discharge conduit and the forward conduit door 90 closed, the current drawn by the motor was about 30% greater than measured for the test using the configuration represented by FIG. 9B. Regular operation of the motor at this higher current value represents a significant load and could be expected to shorten the life of the motor. The only alternative would be to employ a larger and more powerful motor that would require more current to produce the same driving force. Thus, the configuration of FIG. 9B has the dual advantages of reducing the capital cost to the manufacturer and the operational electric power costs to the user.

The effect on the force of the water jet, as determined by measuring the rate of movement of the pool cleaner in feet/minute was found to be negligible with the propeller in the position displaced from the discharge conduit in the embodiment shown in FIG. 9B. Although the diameter of the propellers is slightly smaller in this arrangement, it is apparent that the great majority of the moving water jet is directed into to the conduit (40) and discharged efficiently to propel the pool cleaner in the opposite forward direction.

From the above description of the comparative test results, it can be concluded that the desired propelling forces can be produced using a relatively smaller motor that is both less expensive to purchase and consumes less electrical energy, thereby resulting in reduced operating costs to the user.

Referring to FIGS. 14-16, the pool cleaner of the present invention not only cleans the bottom surface of the pool, but also is capable of ascending and cleaning the sidewalls of the pool. Referring again to FIGS. 4, 7 and 9A, the pool cleaner 10 includes a floatation device 140 positioned along the upper interior surface of the upper housing cover 12A towards the end B of the cleaner proximate the pair of wheels 30. The flotation device 140 (FIGS. 7 and 9A) is fabricated from a material that has sufficient buoyancy to lift end B of the cleaner at least a predetermined angle when the vertical discharge conduit 70 is occluded by the flap valve 96 or the propulsion system is turned off. The floatation device 140 can be an air-filled bladder, or can be fabricated from polystyrene, polyethylene or other water stable foam blocks or sheets, or any other well-known material that provides sufficient buoyancy capable of raising the pair of wheels 30 at end B of the pool cleaner off the bottom surface of the pool.

The pool cleaner 10 can include a ballast member 142 (FIG. 9A) at a position on the base plate 16 towards the opposing first end A of the cleaner that is opposite the flotation device 140 and proximate the single wheel assembly 32. The ballast member 142 can be fabricated from a material that is resistant to water and salt, such as stainless steel, ceramic materials, and the like, and is preferably in the form of a plate. The ballast member 142 is preferably mounted to the interior surface of the base plate 16, so that it does not interfere with the flow of water through the inlet ports 18 and filters 88, although the shape and positioning of the ballast 142 is not to be considered limiting. The ballast 142 can be used to provide stability to the cleaner as it traverses the pool surfaces. The ballast 142 also serves as a counter-weight to the floatation device 140, such that when end B of the cleaner 10 floats upward, the opposite end A with the ballast will not float upwards and the single wheel assembly 32 maintains contact with the surface of the pool. Accordingly, the weight of the ballast 142 is selected to prevent end A of the cleaner from floating upward, but does not prevent the cleaner 10 from climbing a sidewall of the pool when the propulsion system is activated, as described below in further detail with respect to the flow diagram of FIGS. 10A and 10B.

Referring again to FIGS. 4, 9, and 14-16, the pool cleaner 10 includes a propulsion cutoff switch 130, which is electrically coupled to the controller 68 via conductor 138 and the electric motor 60 via conductors 136. Preferably the cutoff switch 130 is a mercury switch that opens or closes to control power to the propulsion system when encountering and negotiating a sidewall of the pool. As illustratively shown in FIGS. 14-16, the mercury switch 130 includes a sealed housing 132 that contains a quantity of mercury 134 that is sufficient to flow between the pair of terminals of conductors 136 to form a conductive circuit path, as well as to contact a terminal of conductor 138 to complete a circuit path to the controller 68. Various types and configurations of mercury switches are well known and have long been used in the art as signal generating sources.

Figure 10A:
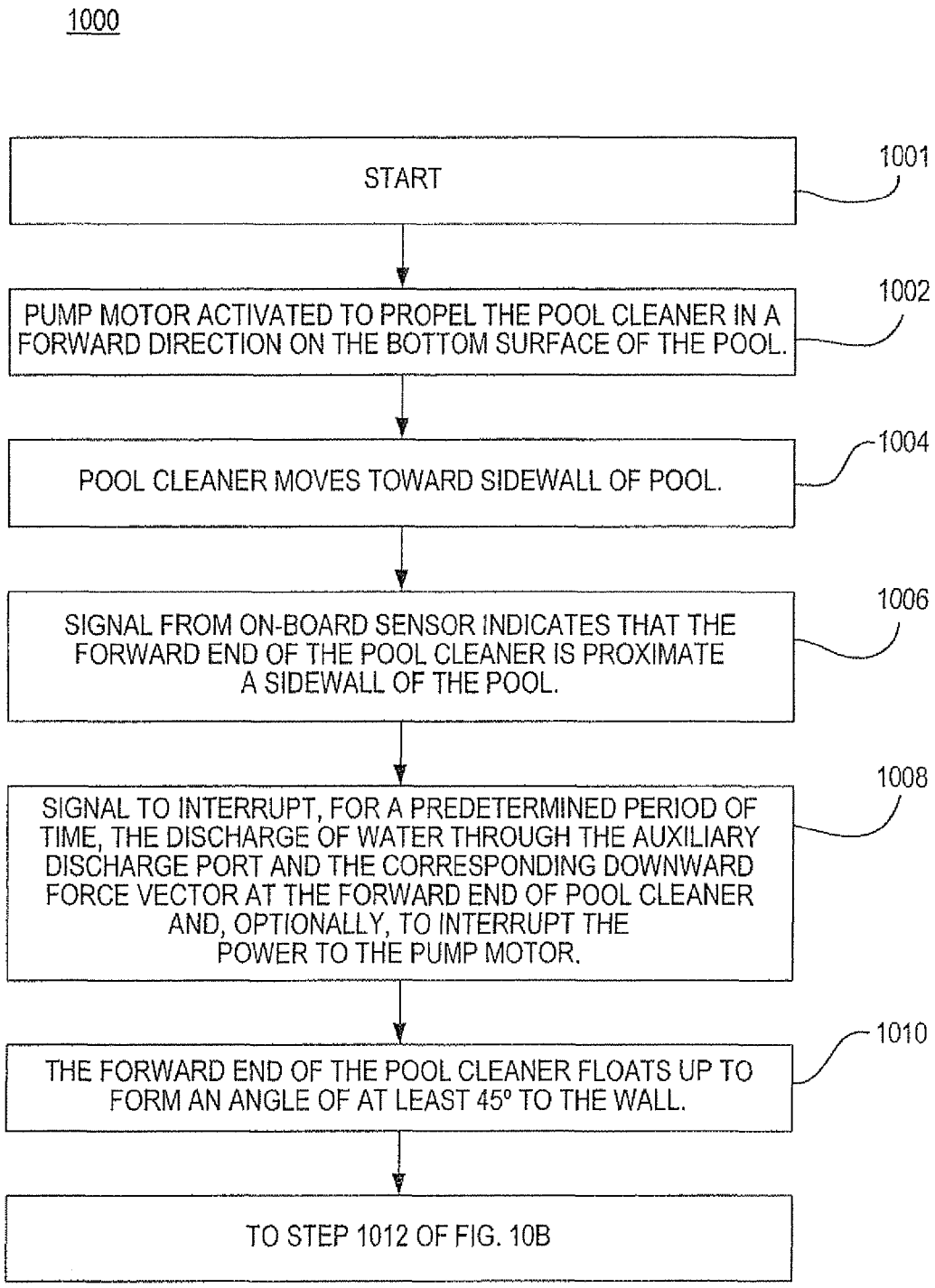
FIGS. 10A and 10B are, collectively, a schematic flow diagram of one method for operating a pool cleaner in accordance with the invention.
Figure 10B:
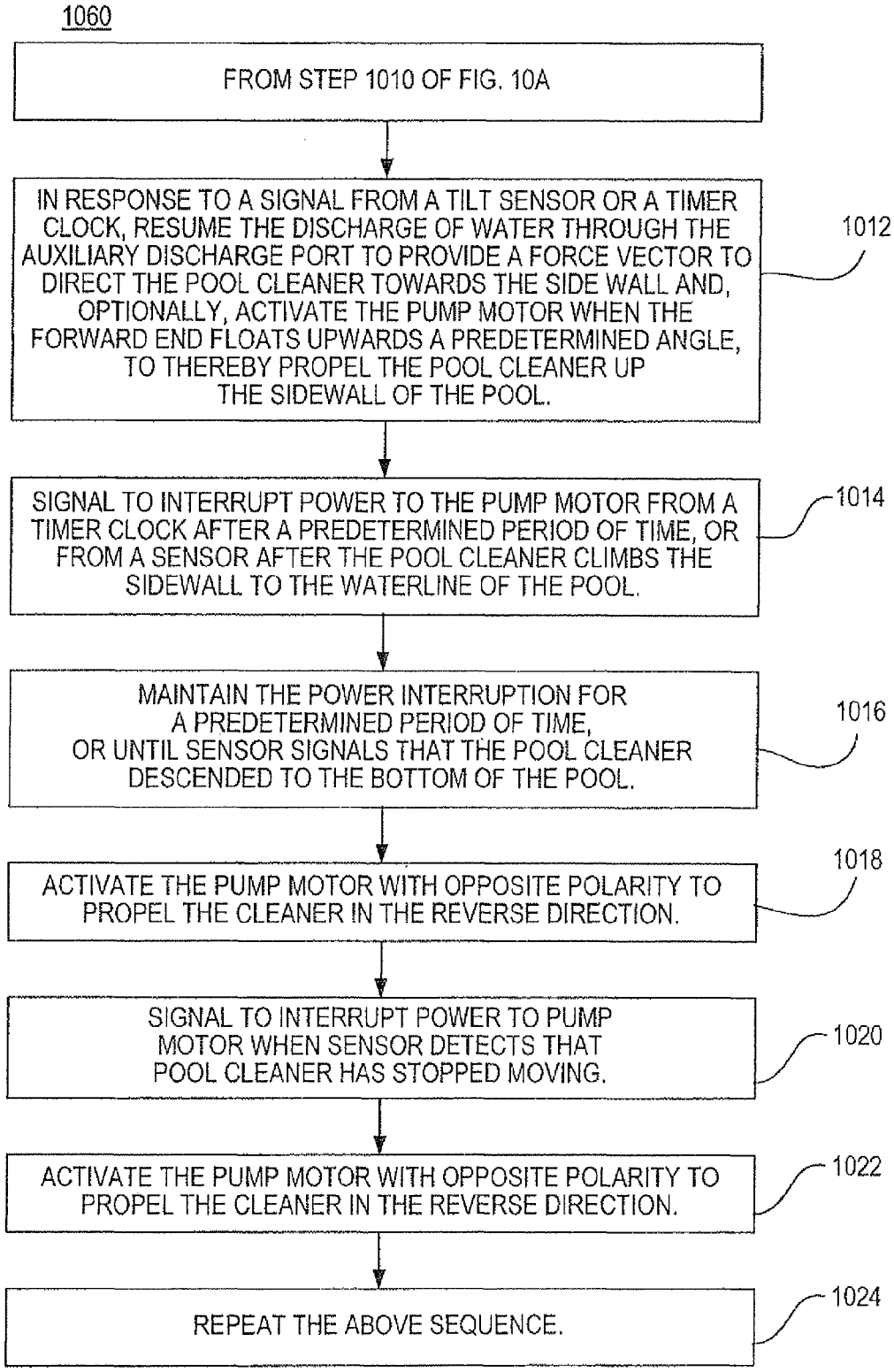

FIGS. 10A and 10B collectively depict a flow diagram of a method 1000 for ascending and descending a vertical sidewall of a pool. FIGS. 10A and 10B should be viewed in conjunction with FIGS. 14-16.

Referring now to FIGS. 10A and 10B, starting with step 1001 in which the pool cleaner is in position on the surface of the bottom of the pool, the pump motor is activated in step 1002 to propel the pool cleaner in a forward direction as defined by the end of the unit having the axle mounted wheels. As indicated in step 1004, the pool cleaner advances to a position adjacent a side wall of the pool, and a signal from an on-board sensor in step 1006 indicates that the forward end of the pool cleaner is in close proximity to the sidewall.

A signal is sent from the processor/controller in step 1008 to interrupt the vertical discharge of pressurized water through the auxiliary discharge port thereby eliminating the downward force vector at the forward end of the pool cleaner. Optionally, the power to the pump motor can also be terminated for a predetermined period of time, or until a signal is received from an orientation sensing device.

Since the forward end of the pool cleaner housing includes a flotation device, the forward end will float up under its effect in step 1010 to form an angle ranging from 45° to 60° with the horizontal.

When the pool cleaner body has achieved an angle of at least 45°, a tilt sensor transmits a signal to the processor/controller in step 1012 and a further signal is generated to reinstitute the discharge of water through the auxiliary discharge port and thereby provide an opposing force vector to direct the pool cleaner towards the side wall in a vertical orientation. In an optional embodiment of step 1012, a timer clock is activated when the vertical discharge of water is interrupted in step 1008 and after a predetermined period of time, the discharge is resumed. The time required for the unit to achieve the desired angular orientation of the forward end can be readily determined by those of ordinary skill in the art using simple experimentation for use in programming the processor/controller. As noted above in conjunction with the description of step 1008, the pump motor can remain activated so that the unit may be moved closer to the wall as the flotation lifts the forward end; if the pump has been interrupted, then it will be reactivated by a signal from the processor/controller at the same time that the discharge of water from the auxiliary discharge port resumes. With the pump motor running, the pool cleaner ascends the side wall of the pool.

When the pool cleaner reaches the water line in step 1014, a signal is sent either by an optional sensor or a time clock that initiated the count of a predetermined period of time after the reactivation of the vertical discharge of water in step 1012.

In accordance with step 1016, the interruption of power to the pump motor is continued for a predetermined period of time as measured by the timer clock, or until a sensor signal is generated indicating that the pool cleaner has again assumed a generally horizontal position on the bottom of the pool. Thereafter, the pump motor is activated in step 1018, in one embodiment with the opposite polarity to propel the pool cleaner in a new direction with the swivel wheel in the forward position. The pool cleaner continues moving in accordance with a pattern determined by the setting of the swivel wheel, which direction may also be affected by encounters with arcuate curve surfaces joining the bottom and side walls of the pool which do not interrupt the movement of the unit and/or encounters with other objects/obstacles in the pool which may deflect the movement of the unit, but do not cause it to come to a complete stop. In accordance with step 1020, a signal is generated to interrupt power to the pump motor when a motion sensor detects that the pool cleaner has stopped moving. Thereafter, the processor/controller reverses the polarity and activates the pump motor in step 1022 to propel the unit in a new direction with the axle-mounted wheels defining the forward end. As indicated in step 1024, the sequence of steps of this process are repeated as in step 1006 when the forward end is proximate a side wall.

Referring to FIGS. 17-20, bottom views schematically illustrating embodiments of the invention in which the cleaner's pair of supporting wheels 30 are mounted on the axle 31 that is offset at an angle to a line that is normal to the longitudinal axis of the cleaner are illustratively shown.

Figure 17:
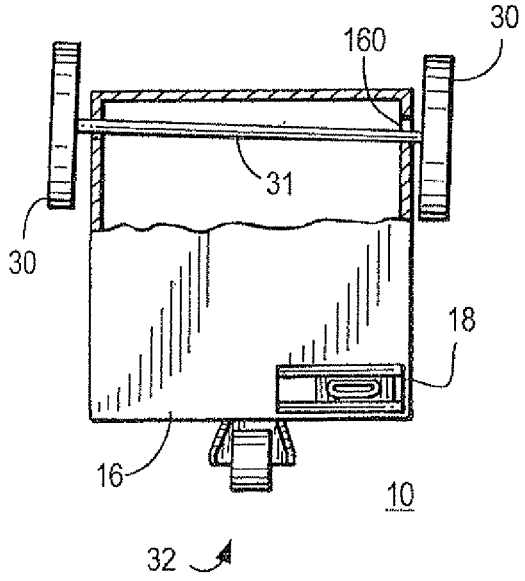
FIGS. 17-20 are bottom plan views of the pool cleaner of FIG. 1 illustrating optional mechanisms for adjusting the positioning of the transverse axle relative to the longitudinal axis of the cleaner.
Figure 18:
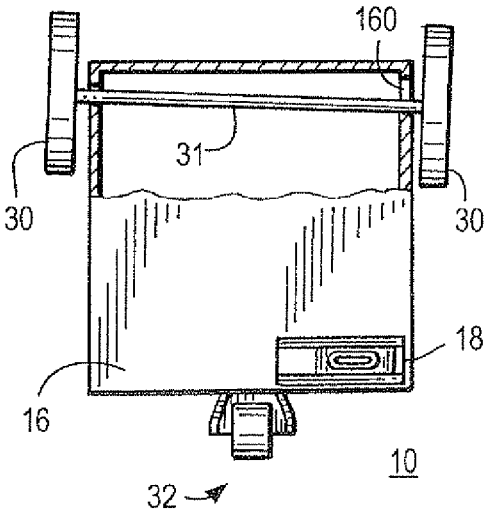

In FIG. 17, the axle 31 is mounted in a slot 160 on one side of the unit so that the wheel 30 adjacent the slot 160 can slide forward and backward with the axle to be either parallel to the cleaner's longitudinal axis, or at an angle thereto, depending on the direction of movement of the cleaner 10. In the embodiment of FIG. 18, the axle swivels in a larger slot 160 to achieve angular positioning of wheels to the robotic cleaner's body in both extreme positions.

From the above description, it will be understood that when operating in a rectangular pool or tank, the embodiments shown in FIGS. 17 and 18 allow the robot to move parallel to the swimming pool's end walls, even when it travels other than perpendicular to the sidewalls. In other words, the correct scanning pattern does not require an angular change in the alignment of the robot's body caused by a forceful contact with a swimming pool wall as with the prior art. This feature is particularly important where a water jet propulsion means is employed because as the filter assembly accumulates debris in the jet propulsion system, the force of the water jet weakens and the force of impact lessens, so that the cleaner's body may not may not be able to complete the pivoting action required to put it into the correct position before it reverses direction. This disadvantage is especially true in Gunite or other rough-surfaced pools in which a pool cleaner with even a clean filter assembly may not be able to pivot into proper position, since the resistance or frictional forces between the wheels and the bottom surface of pool may be too great to allow the necessary side-ways sliding of the wheels before reversal of the motor occurs.

Figure 19:
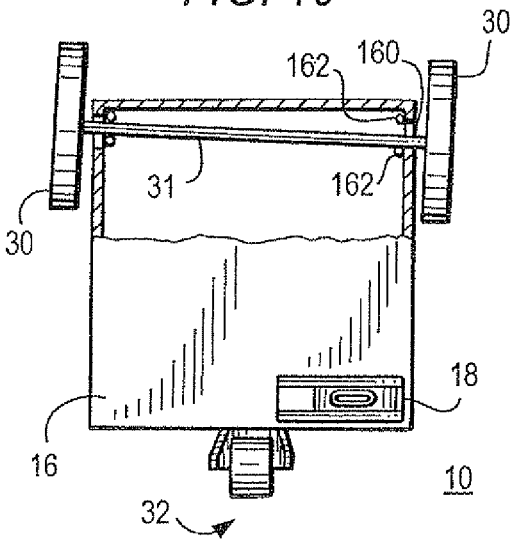

As shown in FIG. 19, one end of the axle 31 is mounted in a corresponding slot 160 to permit the axle 31 to move longitudinally at that end. This longitudinal sliding motion can be restricted by one or more repositionable guide pins 162. These pins 162 allow the user to adjust the angular positioning of the axle 31 to accommodate the width or other characteristics of the pool and achieve an optimum scanning pattern for the cleaner.

Figure 20:
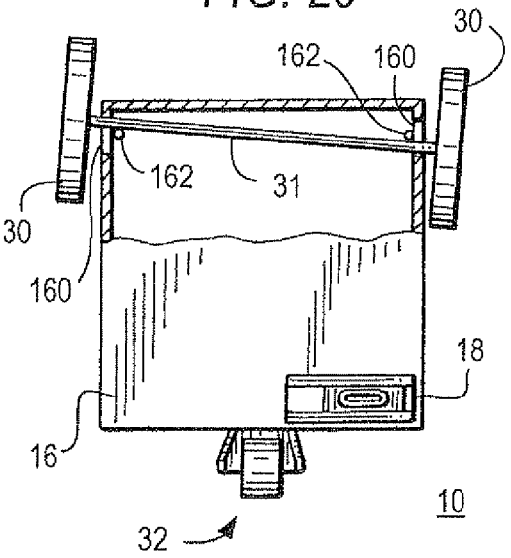

In FIG. 20, each end of the axle 31 is mounted in a corresponding slot 162 to permit longitudinal movement at both ends. This will allow the robotic cleaner 10 with proper positioning of the guide pins 162 to advance in a relatively small arcuate pattern in one direction and in a different larger one in the other.

The use of this method and apparatus are known in the art and are also described in detail in U.S. Pat. No. 6,412,133 referred to above. The optional predetermined movement of the end(s) of the axle(s) will provide patterned movement of the pool cleaner that afford the user the opportunity to make the selection in order to customize the unit to maximize the efficient cleaning of round, oval, rectangular and kidney-shaped pools of varying sizes.

The invention has been described and illustrated in detail and various modifications and enhancements will become apparent to those of ordinary skill in the art from this disclosure. The scope of the invention and its protection are therefore to be determined with references to the following claims.

We claim:

1. A self-propelled pool cleaner for cleaning a submerged surface of a pool or tank comprising:

a water pump that includes a reversible electric pump motor having a drive shaft with a first propeller connected to one end of the drive shaft and a second propeller connected to an opposing end of the drive shaft, the axis of the drive shaft extending along a longitudinal axis of the pool cleaner;

a housing having an upper portion over a lower portion and defining an interior chamber in which the water pump is mounted, the upper portion of the housing having a first discharge port at one end and a second discharge port at an other end of the housing, each of the discharge ports selectively being in an open position while the other is in a closed position to directionally discharge a water jet that propels the pool cleaner in a direction of movement corresponding generally to the longitudinal axis of the pool cleaner;

a pair of discharge conduits, wherein one of the pair of discharge conduits is positioned between the reversible electric pump motor and one of the first or second discharge ports at one end of the housing, and the other of the pair of discharge conduits is positioned between the reversible electric pump motor and the other of the first or second discharge ports at the other end of the housing, the first propeller being positioned adjacent to one of the pair of the discharge conduits in the interior chamber and the second propeller being positioned adjacent to the other of the pair of discharge conduits in the interior chamber; and wherein pressurized water selectively discharged as the water jet by one or the other of the discharge ports is determined by a direction of rotation of the drive shaft of the reversible electric pump motor.

2. The self-propelled pool cleaner of claim 1 in which the longitudinal axes of the discharge conduits coincide with the center of rotation of the adjacently positioned propellers.

3. The self-propelled pool cleaner of claim 1 in which an outside diameter of each propeller is smaller than the inside diameter of an adjacent fluid inlet end of each discharge conduit.

4. The self-propelled pool cleaner of claim 1 in which each propeller includes a plurality of blades, wherein the blades, diameter and position of each propeller are configured to maximize volumetric flow rate of the water jet generated by the propeller into the respective adjacent discharge conduit.

5. The self-propelled pool cleaner of claim 1, wherein the first propeller provides a first output water flow generally longitudinally aligned with the first discharge port, and the second propeller provides a second output water flow generally longitudinally aligned with the second discharge port.

6. The self-propelled pool cleaner of claim 1, wherein rotation of the drive shaft in one direction causes the first and second propellers to rotate in a like rotational direction to produce a low pressure zone at one end of the housing that closes the discharge port adjacent to the first or second propeller, and to produce a high pressure zone that opens the discharge port adjacent the other of the first or second propeller.

7. The self-propelled pool cleaner of claim 6, wherein reversing the rotational direction of both first and second propellers reverses the low and high pressure zones at the respective ends of the housing so as to close the previously open discharge port and open the previously closed discharge port.

8. The self-propelled pool cleaner of claim 1, further comprising at least one filter mounted in the housing to capture debris entrained in water flowing between at least one inlet port provided in the lower portion of the housing and one of the first and second discharge ports.

9. The self-propelled pool cleaner of claim 8, wherein the at least one filter includes first and second filters each of which having a longitudinal axis, the first and second filters being longitudinally mounted in the housing in a direction of the longitudinal axis of the pool cleaner.

10. The self-propelled pool cleaner of claim 1, further comprising a controller operably coupled to the reversible electric pump motor, said controller providing control signals to regulate the direction of rotation of the reversible electric pump motor.

11. The self-propelled pool cleaner of claim 1, wherein the reversible electric pump motor includes opposing streamlined end plates extending from the periphery of the reversible electric pump motor to the drive shaft to minimize turbulence adjacent the end of the reversible electric pump motor.

12. The self-propelled pool cleaner of claim 1, wherein each end of the housing includes a vertical discharge port in fluid communication with the interior of the housing for selectively discharging an upwardly directed water jet that is generally normal to the surface being cleaned so as to exert a downward force vector.

13. The self-propelled pool cleaner of claim 12, wherein rotation of the first and second propellers by the drive shaft in a clockwise or counter-clockwise rotational direction produces a discharge of the upwardly directed water jet from one of the vertical discharge ports of the submerged pool cleaner.

14. The self-propelled pool cleaner of claim 1, further comprising a water jet discharge valve associated with, and to open and close each discharge port.

15. The self-propelled pool cleaner of claim 14, wherein each water jet discharge valve is a flap valve.

16. The self-propelled pool cleaner of claim 14 in which each water jet discharge valve comprises two centrally hinged portions that pivot into an open position in the center of each of the discharge conduits.

17. The self-propelled pool cleaner of claim 14, wherein each water jet discharge valve is positioned in one of the discharge conduits.

18. The self-propelled pool cleaner of claim 14, wherein the water jet discharge valve associated with each discharge port is down stream of the respective first and second propellers.

19. The self-propelled pool cleaner of claim 14, wherein operation of each water jet discharge valve is responsive to the flow of pressurized water from the first and second propellers.

20. The self-propelled pool cleaner of claim 1, wherein the water jet is discharged through the open discharge port at an acute angle with respect to a pool surface being cleaned.

21. The self-propelled pool cleaner of claim 1, wherein the first and second propellers are configured to rotate simultaneously in a common rotational direction.

* * * * *